US008419448B2

(12) United States Patent
Konno

(10) Patent No.: US 8,419,448 B2
(45) Date of Patent: Apr. 16, 2013

(54) ELASTIC CONNECTOR, METHOD OF MANUFACTURING ELASTIC CONNECTOR, AND ELECTRIC CONNECTION TOOL

(75) Inventor: Hideaki Konno, Tokyo (JP)

(73) Assignee: Polymatech Co., Ltd., Tokyo (JP)

( * ) Notice: Subject to any disclaimer, the term of this patent is extended or adjusted under 35 U.S.C. 154(b) by 0 days.

(21) Appl. No.: 13/254,315

(22) PCT Filed: Mar. 1, 2010

(86) PCT No.: PCT/JP2010/053277
§ 371 (c)(1),
(2), (4) Date: Sep. 1, 2011

(87) PCT Pub. No.: WO2010/101125
PCT Pub. Date: Sep. 10, 2010

(65) Prior Publication Data

US 2011/0318961 A1 Dec. 29, 2011

(30) Foreign Application Priority Data

Mar. 5, 2009 (JP) ..... 2009-052313

(51) Int. Cl.
*H01R 4/58* (2006.01)

(52) U.S. Cl.
USPC ..... 439/86; 29/883

(58) Field of Classification Search ..... 439/66, 439/91, 86; 29/874, 882, 883
See application file for complete search history.

(56) References Cited

U.S. PATENT DOCUMENTS 4,644,101 A * 2/1987 Jin et al. ..... 178/18.05
4,737,112 A * 4/1988 Jin et al. ..... 439/66
4,820,376 A * 4/1989 Lambert et al. ..... 216/11
5,213,715 A * 5/1993 Patterson et al. ..... 252/514
(Continued)

FOREIGN PATENT DOCUMENTS

| | | | |
|---|---|---|---|
| JP | 09-259959 | A | 10/1997 |
| JP | 2000-150009 | A | 5/2000 |
| JP | 2003-257542 | A | 9/2003 |
| JP | 2005-178092 | A | 7/2005 |

OTHER PUBLICATIONS

International Search Report for PCT Patent App. No. PCT/JP2010/053277 (Apr. 13, 2010).

*Primary Examiner* — Ross Gushi
(74) *Attorney, Agent, or Firm* — Cermak Nakajima LLP; Tomoko Nakajima

(57) ABSTRACT

The present invention provides technology with high production efficiency for an elastic connector that electrically connects two connection target members. The technology enables an initial product to be quickly completed with a low initial cost, in correspondence to any distance between the connection target members and any angle formed between them. An elastic connector was obtained by forming a major-axis columnar body, in which a conductive part was formed by cross linking and hardening (solidifying) conductive members inside a tube-like part formed of an insulative rubber tube, and then cutting the major-axis columnar body with a cutting blade along a cutting line, which is in a direction crossing the axis of the major-axis columnar body, to shorten the major-axis columnar body. This elastic connector eliminates the need to create a new metal mold in its manufacturing. When a length to which the major-axis columnar body is cut is appropriately changed and it is cut to that length, an elastic connector that suit any distance between the connection target members and any angle formed between them can be obtained.

16 Claims, 19 Drawing Sheets

U.S. PATENT DOCUMENTS 5,509,815 A * 4/1996 Jin et al. ..... 439/91
5,618,189 A * 4/1997 Jin et al. ..... 439/91
5,624,268 A * 4/1997 Maeda et al. ..... 439/66
5,788,516 A * 8/1998 Uggmark ..... 439/86
5,975,922 A * 11/1999 Jin ..... 439/91
6,017,225 A * 1/2000 Michiya et al. ..... 439/91
6,052,286 A * 4/2000 Worthen et al. ..... 361/765
6,081,429 A * 6/2000 Barrett ..... 361/767
6,168,442 B1 * 1/2001 Naoi ..... 439/91
6,217,349 B1 * 4/2001 Konno ..... 439/91
6,224,394 B1 * 5/2001 Matsumoto ..... 439/66
6,264,476 B1 * 7/2001 Li et al. ..... 439/66
6,307,946 B1 * 10/2001 Fujimoto et al. ..... 381/355
6,447,308 B1 * 9/2002 McCarthy et al. ..... 439/91
6,604,953 B2 * 8/2003 Igarashi et al. ..... 439/91
6,613,267 B1 * 9/2003 Konno ..... 264/437
6,773,300 B1 * 8/2004 Sudo et al. ..... 439/500
6,848,914 B2 * 2/2005 Beaman et al. ..... 439/66
6,854,985 B1 * 2/2005 Weiss ..... 439/91
7,040,902 B2 * 5/2006 Li ..... 439/66
7,059,874 B2 * 6/2006 Weiss ..... 439/91
7,083,436 B2 * 8/2006 Brodsky ..... 439/91
7,090,478 B2 * 8/2006 Wada et al. ..... 425/3
7,131,851 B2 * 11/2006 Setaka et al. ..... 439/86
7,156,669 B2 * 1/2007 Asai et al. ..... 439/91
7,264,482 B2 * 9/2007 Hasegawa ..... 439/66
7,267,559 B2 * 9/2007 Hashitani et al. ..... 439/91
7,309,244 B2 * 12/2007 Yamada et al. ..... 439/91
7,384,279 B2 * 6/2008 Igarashi et al. ..... 439/91
7,384,280 B2 * 6/2008 Yamada et al. ..... 439/91
7,537,459 B2 * 5/2009 Takegahara et al. ..... 439/66
7,618,267 B2 * 11/2009 Konno et al. ..... 439/91
7,690,932 B2 * 4/2010 Nakaone ..... 439/91
7,724,539 B2 * 5/2010 Konno ..... 361/807
7,815,998 B2 * 10/2010 Simpson et al. ..... 428/317.9
7,922,497 B2 * 4/2011 Yamada et al. ..... 439/66
8,124,885 B2 * 2/2012 Yamada et al. ..... 174/265
2004/0164462 A1 * 8/2004 Wada et al. ..... 264/429
2004/0168318 A1 * 9/2004 Johnson ..... 29/876
2004/0192080 A1 * 9/2004 Li ..... 439/66
2005/0272282 A1 * 12/2005 Setaka et al. ..... 439/86
2006/0057867 A1 * 3/2006 Brodsky et al. ..... 439/66
2006/0094269 A1 * 5/2006 Li ..... 439/86
2006/0148285 A1 * 7/2006 Naoi ..... 439/86
2006/0199405 A1 * 9/2006 Sato et al. ..... 439/91
2006/0211276 A1 * 9/2006 Li ..... 439/66
2007/0195512 A1 * 8/2007 Konno ..... 361/771
2007/0224847 A1 * 9/2007 Umezawa et al. ..... 439/66
2007/0281516 A1 * 12/2007 Yamada et al. ..... 439/91
2007/0293062 A1 * 12/2007 Sato et al. ..... 439/91
2009/0053907 A1 * 2/2009 Konno et al. ..... 439/38
2009/0230975 A1 * 9/2009 Yamada et al. ..... 324/537
2010/0159718 A1 * 6/2010 Duquerroy et al. ..... 439/66
2011/0318961 A1 * 12/2011 Konno ..... 439/586

* cited by examiner

ELASTIC CONNECTOR, METHOD OF MANUFACTURING ELASTIC CONNECTOR, AND ELECTRIC CONNECTION TOOL

This application is a national phase entry under 35 U.S.C. §371 of PCT Patent Application No. PCT/JP2010/053277, filed on Mar. 1, 2010, which claims priority under 35 U.S.C. §119 to Japanese Patent Application No. 2009-052313, filed Mar. 5, 2009, both of which are incorporated by reference.

TECHNICAL FIELD

The present invention relates to an elastic connector, a method of manufacturing the elastic connector, and an electric connection tool. The elastic connector is built into a mobile information terminal, an information device such as a notebook personal computer, an AV device such as a small-sized audio player or small-sized display, or any of other various types of electronic devices to provide an electric connection between circuit boards, between a circuit board and an electronic component, between a circuit board and a conductive part provided on an exterior component of a device, and between other various types of parts or members.

BACKGROUND ART

An elastic connector 1 shown in FIGS. 29 and 30 is an example of an elastic connector that electrically interconnects, for example, a circuit board and an electronic component. The elastic connector 1 is formed as a cylindrical body with a side circumferential part 2, which is formed of an insulative rubber elastic body, and an elastic conductive part 3 disposed inside the side circumferential part 2. The elastic conductive part 3 is exposed on both end surfaces 1*a* and 1*a* of the side circumferential part 2, providing conductivity in the axial direction of the cylindrical body. The elastic conductive part 3 of the elastic connector 1 is formed by blending conductive bodies into the rubber elastic body.

When the elastic connector 1 of this type is attached to an electronic device, there is no need to use a securing means such as soldering and mechanical joining; opposing contacts (electrodes) can be easily connected by bringing each end surface 1*a* into contact with one of the opposing contacts and pressing the end surface 1*a* against the contact. Since the side circumferential part 2 can absorb vibration from the outside of the device, a connection failure due to displacement can be made hard to occur. Furthermore, it is possible to prevent the elastic conductive part 3 from wearing and discharging, achieving a reliable electric connection.

The elastic connector 1 is disclosed in, for example, PTL 1. An example of an anisotropic conductive sheet having a plurality of elastic conductive parts is disclosed in, for example, PTL 2. The elastic connector 1 and anisotropic conductive sheet, which respectively has an elastic conductive part and a plurality of elastic conductive parts as described above, are manufactured by being metal molded to achieve efficient production, easy operation, and a high yield.

CITATION LIST

Patent Literature

PTL 1: Japanese Unexamined Patent Application Publication No. 2003-257542

PTL 2: Japanese Unexamined Patent Application Publication No. 2005-178092

SUMMARY OF INVENTION

Technical Problem

Since the elastic connector 1 and anisotropic conductive sheet described above are manufactured by being metal molded, if products having the elastic conductive part 3 with different heights (axial lengths) are manufactured, a different metal mold is required for each product. When the manufacturing of a new product is started, therefore, a new metal mold needs to be created. This is problematic in that a period until the new product is completed is prolonged and the initial cost is increased. In particular, when magnetic conductive bodies are used to form an elastic conductive part in which the magnetic conductive bodies are oriented by a magnetic field, a mold cost tends to be increased because a magnetic core material needs to be embedded in the mold to have magnetism concentrate, increasing the initial cost. When a product that has been manufactured is changed to another product in a production factory, its mold needs to be replaced. This is problematic in that a time taken for production line preparation is prolonged and the production efficiency is thereby lowered. Accordingly, the elastic connector 1 and anisotropic conductive sheet described above are not suitable particularly to products manufactured in large item small volume production.

In the background of the prior art described above, the present invention was devised. That is, an object of the present invention is to provide technology with high production efficiency that can quickly complete an initial product with a low initial cost even if the initial product includes an elastic conductive part having a different height from another product.

Solution to Problem

To achieve the above object, the present invention is configured as described below.

That is, the present invention provides an elastic connector that is formed of a columnar body including an insulative tube-like part having rubber elasticity and a conductive part passing through the tube-like part in the axial direction of the tube-like part, different connection target members being electrically connected to each other when one end and another end at which the conductive part is exposed are brought into contact with the different connection target members; the conductive part is formed by solidifying a rubber elastic body including a conductive body inside the tube-like part; at least one of the one end and the other end is a cut surface formed by cutting a major-axis columnar body having the tube-like part and the conductive part in a direction crossing the axis of the major-axis columnar body.

The present invention provides an elastic connector that is formed of a columnar body including an insulative tube-like part having rubber elasticity and a conductive part passing through the tube-like part in the axial direction of the tube-like part, different connection target members being electrically connected to each other when one end and another end at which the conductive part is exposed are brought into contact with the different connection target members; the conductive part is formed by solidifying a rubber elastic body including a conductive body inside the tube-like part. According, the conductive part can be formed by using the tube-like part as a substitute for a mold. Since at least one of the one end and the other end at which the conductive part is exposed is a cut surface formed by cutting a major-axis columnar body, formed so as to be elongated, in a direction crossing the axis of the major-axis columnar body, the elastic connector can be easily manufactured by appropriately adjusting the length of the columnar body, eliminating a cost and a labor involved in the manufacturing of a mold.

The cut surface is a surface formed by cutting with a blade, a wire, or any of other various types of cutting means, and is not a surface formed by a mold.

The present invention provides an elastic connector that is formed of a columnar body including an insulative tube-like part having rubber elasticity and a conductive part passing through the tube-like part in the axial direction of the tube-like part, different connection target members being electrically connected to each other when one end and another end at which the conductive part is exposed are brought into contact with the different connection target members; the conductive part is formed by solidifying a rubber elastic body including a conductive body inside the tube-like part; a major-axis columnar body having the tube-like part and the conductive part is cut in a direction crossing the axis of the major-axis columnar body to shorten the major-axis columnar body.

The present invention provides an elastic connector that is formed of a columnar body including an insulative tube-like part having rubber elasticity and a conductive part passing through the tube-like part in the axial direction of the tube-like part, different connection target members being electrically connected to each other when one end and another end at which the conductive part is exposed are brought into contact with the different connection target members; since the conductive part is formed by solidifying a rubber elastic body including a conductive body inside the tube-like part, the conductive part can be formed by using the tube-like part as a substitute for a mold.

Since the elastic connector is formed by cutting a major-axis columnar body having the tube-like part and conductive part in a direction crossing the axis of the major-axis columnar body to shorten the major-axis columnar body, the elastic connector can be easily manufactured by appropriately adjusting the length of the columnar body, eliminating a cost and a labor involved in the manufacturing of a mold.

As for the elastic connector of this type, the conductive part can be formed by forming a current flow path, in which magnetic conductive bodies are chained and oriented in the axial direction of the tube-like part, in the rubber elastic body. Since the conductive part is formed by forming a current flow path, in which magnetic conductive bodies are chained and oriented in the axial direction of the tube-like part, in the rubber elastic body, conductivity can be increased even if the amount of blended conductive bodies is reduced in comparison with conductive rubber in which conductive bodies are evenly distributed in the rubber elastic body, so the hardness of the conductive part can be reduced. Accordingly, a pressing load to be applied to a connection target member can be reduced.

As the conductive part, the elastic connector can have a magnetic conductive part to which surface treatment has been applied to increase the ease of adhesion to the rubber elastic body.

Even if the elastic connector is manufactured by cutting the major-axis columnar body having the tube-like part and conductive part, since the conductive part is the magnetic conductive part to which surface treatment has been applied to increase the ease of adhesion to the rubber elastic body, the adhesion force of the conductive part is high, making the conductive part hard to come off an end surface of the elastic connector.

The elastic connector can have a plurality of independent through-holes inside the tube-like part, which are covered by the conductive part.

Since the elastic connector has a plurality of independent through-holes inside the tube-like part, which are covered by the conductive part, the elastic connector has a plurality of conductive parts. Therefore, an electric connection is surely provided between connection target members, achieving an elastic connector having high reliability in electric connection. Since the plurality of conductive parts can be distributed to a plurality of electrodes of the connection target members, a plurality of different conductive paths can be formed. Furthermore, it is also easy to appropriately change the shapes of the tube-like part and conductive part to suit a complex electrode placement of the connection target members, enabling the elastic connector to easily conform to various types of electrode patterns.

The tube-like part of the elastic connector can be formed of an outer tube-like part exposed to the outside and a small-diameter tube-like part embedded inside the outer tube-like part.

Since the tube-like part is formed of an outer tube-like part exposed to the outside and a small-diameter tube-like part embedded inside the outer tube-like part, a conductive path can be formed in the small-diameter tube-like part besides the conductive path in the outer tube-like part. Accordingly, when an elastic connector formed of the small-diameter tube-like part is manufactured, and a plurality of small-diameter elastic connectors are combined, an elastic connector with a large diameter can be easily obtained. Therefore, manufacturing is simplified, the shape of the end surface can be easily controlled, and the elastic connector can have a large diameter.

The elastic connector can have a cut trace that extends from the surface of the tube-like part to the conductive part and also extends along the axial direction of the tube-like part.

Since the cut trace extends from the surface of the tube-like part to the conductive part and also extends along the axial direction of the tube-like part, the trace of an incision or opening that has been formed when the conductive part is formed in the through-hole formed inside the tube-like part can be used as the cut trace. Since a cut trace of this type is present, even if the tube-like part is an elongated major-axis tube-like part, the cut trace enables the conductive part to be easily formed by pouring a material used to form the conductive part from the cut trace, so an elastic connector having high mass productivity can be obtained.

An end surface of the elastic connector, on which both the conductive part and tube-like part are exposed, can be formed as an inclined surface angled with respect to the axial direction of the tube-like part. Since an end surface, on which both the conductive part and tube-like part are exposed, is formed as an inclined surface angled with respect to the axial direction of the tube-like part, the end surface can be shaped so as to be a cusp. Accordingly, a pressing load to be applied to the connection target member can be reduced.

The present invention provides a method of manufacturing an elastic connector that is formed of a columnar body including an insulative tube-like part having rubber elasticity and a conductive part passing through the tube-like part in the axial direction of the tube-like part, different connection target members being electrically connected to each other when one end and another end at which the conductive part is exposed are brought into contact with the different connection target members; the method executes a conductive part filling step of filling the inside of the tube-like part with a flowable rubber elastic body in which conductive bodies are dispersed, a step of obtaining a major-axis columnar body having the tube-like part and the conductive part by solidifying the rubber elastic body to form the conductive part inside the tube-like part, and a step of obtaining a columnar body having a cut surface on which the tube-like part and the conductive part are exposed by cutting the major-axis columnar body in a direction crossing the axis of the major-axis columnar body to shorten the major-axis columnar body.

Since the method includes the conductive part filling step of filling the inside of the tube-like part with a flowable rubber elastic body in which conductive bodies are dispersed, a portion formed as the insulative tube-like part and a portion formed as the conductive part can be separately manufactured. Accordingly, a range in which the properties of the conductive part can be changed according to required characteristics can be widened; for example, the conductivity of the conductive part can be improved or the conductive part can be relatively softened.

Since the method includes the step of obtaining a major-axis columnar body having the tube-like part and the conductive part by solidifying the rubber elastic body to form the conductive part inside the tube-like part, the major-axis columnar body having the conductive part and the tube-like part, which is at a stage before the elastic connector, can be obtained without having to use a metal mold. Accordingly, a mold manufacturing cost can be eliminated and an elastic connector manufactured a low unit cost can be thereby obtained.

Since the method executes the step of obtaining a columnar body having a cut surface on which the tube-like part and the conductive part are exposed by cutting the major-axis columnar body in a direction crossing the axis of the major-axis columnar body to shorten the major-axis columnar body, elastic connectors having various tube lengths and elastic connectors having the same tube length can be obtained from one major-axis columnar body just by setting appropriate lengths to which the major-axis columnar body is cut.

The process of obtaining the major-axis columnar body can be a process of applying a magnetic field to a rubber elastic body including magnetic conductive bodies along its axial direction to orient the magnetic conductive bodies and then hardening the rubber elastic body. Since the process of obtaining the major-axis columnar body can be a process of applying a magnetic field to a rubber elastic body including magnetic conductive bodies along its axial direction to orient the magnetic conductive bodies and then hardening the rubber elastic body, an elastic connector with high conductivity and high flexibility can be obtained with less conductive bodies. Accordingly, the elastic connector has higher conductivity and requires a lower pressing load to be applied to connection target members in comparison with a case in which the conductive part is formed by using conductive rubber in which conductive bodies are evenly distributed in a rubber elastic body.

Alternatively, the present invention provides an electric connection tool, used for connection target members, that has an elastic connector for electrically connecting different target members to each other by bringing one end and another end of a conductive part into contact with the different connection target members; the electric connection tool has any one of the elastic connectors described above and a connector auxiliary tool that has a hole through which the elastic connector passes and is built into an electronic device while the elastic connector is held in the hole; both ends of the elastic connector extend from the hole in the connector auxiliary tool, and when the different connection target members are brought into contact with both ends, the connection target members and the elastic connector are placed in contact with each other by being pressed.

Since the electric connection tool, used for connection target members, has a connector auxiliary tool that has a hole through which the elastic connector passes and is built into an electronic device while the elastic connector is held in the hole and both ends of the elastic connector extending from the connector auxiliary hole are brought into contact with the connection target members by being pressed, the elastic connector can be used to electrically connect connection target members of different types to each other, which are intended to be electrically connected, regardless of the placement of and the distance between the connection target members.

Advantageous Effects of Invention

According to the elastic connector and the method of manufacturing the elastic connector in the present invention, the elastic connector can be obtained by cutting a major-axis columnar body having a conductive part in a tube-like part, the elastic connector can adapt to various distances between electrodes to be electrically connected, and volume production of the elastic connector can be easily achieved with a low initial cost and high manufacturing efficiency.

According to the electric connection tool used for connection target members in the present invention, an elastic connector can be used to electrically connect connection target members of different types to each other, which are intended to be electrically connected, regardless of the placement of and the distance between the connection target members.

BRIEF DESCRIPTION OF DRAWINGS

FIG. 26(A) is a plan view, FIG. 26(B) a cross sectional view taken along line IIVIB-IIVIB in FIG. 26(A), and FIG. 26(C) is a cross sectional view taken along line IIVIC-IIVIC in FIG. 26(A).

FIG. 28(A) is a plan view, FIG. 28(B) a cross sectional view taken along line IIVIIIB-IIVIIIB in FIG. 28(A), and FIG. 28 (C) is a cross sectional view taken along line IIVIIIC-IIVIIIC in FIG. 28(A).

DESCRIPTION OF EMBODIMENTS

Figure 1:
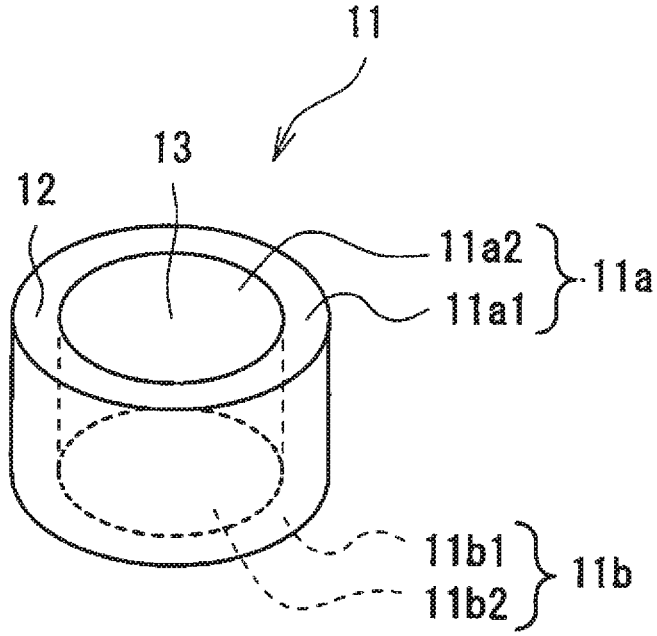
FIG. 1 is a perspective view of an elastic connector in a first embodiment.

The present invention will be described further in detail with reference to the drawings. Structures common to embodiments are assigned like reference characters to eliminate duplicate descriptions.

First Embodiment

Elastic Connector Having a Single Conductive Part [FIGS. 1 to 6]

An example of an elastic connector having a single conductive part is shown in FIG. 1.

The elastic connector 11 has a tube-like part 12 and a conductive part 13.

The tube-like part 12 is made of an insulative material having rubber elasticity, and is formed in a cylindrical tubular shape. The conductive part 13 is made of a conductive material, and is formed in a cylindrical shape so as to fill a hollow 12*b* of the tube-like part 12. The tube-like part 12 and conductive part 13 form a columnar body. With the elastic connector 11, one conductive part 13 is formed.

An end surface 11*a* (11*b*) of the columnar body formed of an end surface 11*a*1 (11*b*1) on which the tube-like part 12 is exposed and an end surface 11*a*2 (11*b*2) on which the conductive part 13 is exposed is a cut surface formed by being cut with a cutting knife or the like. Of these cut surfaces, the end surfaces 11*a*2 and 11*b*2 of the conductive part 13 form electrodes that are brought into contact with connection target members.

As the material of the tube-like part 12, an insulative thermosetting rubber having rubber elasticity or a thermoplastic elastomer can be used. Examples include natural rubber, silicone rubber, isoprene rubber, butadiene rubber, acrylonitrile butadiene rubber, 1,2-polybutadiene, styrene-butadiene rubber, chloroprene rubber, nitrile rubber, butyl rubber, ethylene-propylene rubber, chlorosulfonic rubber, polyethylene rubber, acrylic rubber, epichlorohydrin rubber, fluorine rubber, urethane rubber, styrene-based thermoplastic elastomer, olefin-based thermoplastic elastomer, ester-based thermoplastic elastomer, urethane-based thermoplastic elastomer, amide-based thermoplastic elastomer, vinyl-chloride-based thermoplastic elastomer, fluorine-based thermoplastic elastomer, and ion-cross-linked thermoplastic elastomer.

If a conductive member is manufactured by thermosetting it in the tube-like part 12 as described later, thermosetting rubber is preferably used and, in particular, silicone rubber and fluorine rubber, which have high heat resistance, are more preferable.

Primer treatment is preferably applied to the inner surface of the tube-like part 12 in advance because a force with which the tube-like part 12 and conductive part 13 are attached to each other can be increased during the formation of the conductive part 13 described later.

The conductive part 13 is formed by solidifying a rubber elastic body 13*a*, which includes conductive bodies 13*b*, inside the tube-like part 12. The conductive part 13 can be formed like a conductive rubber in which the conductive bodies 13*b* are evenly distributed in the rubber elastic body 13*a* and the entire conductive part 13 forms a current flow path (not shown).

Figure 2:
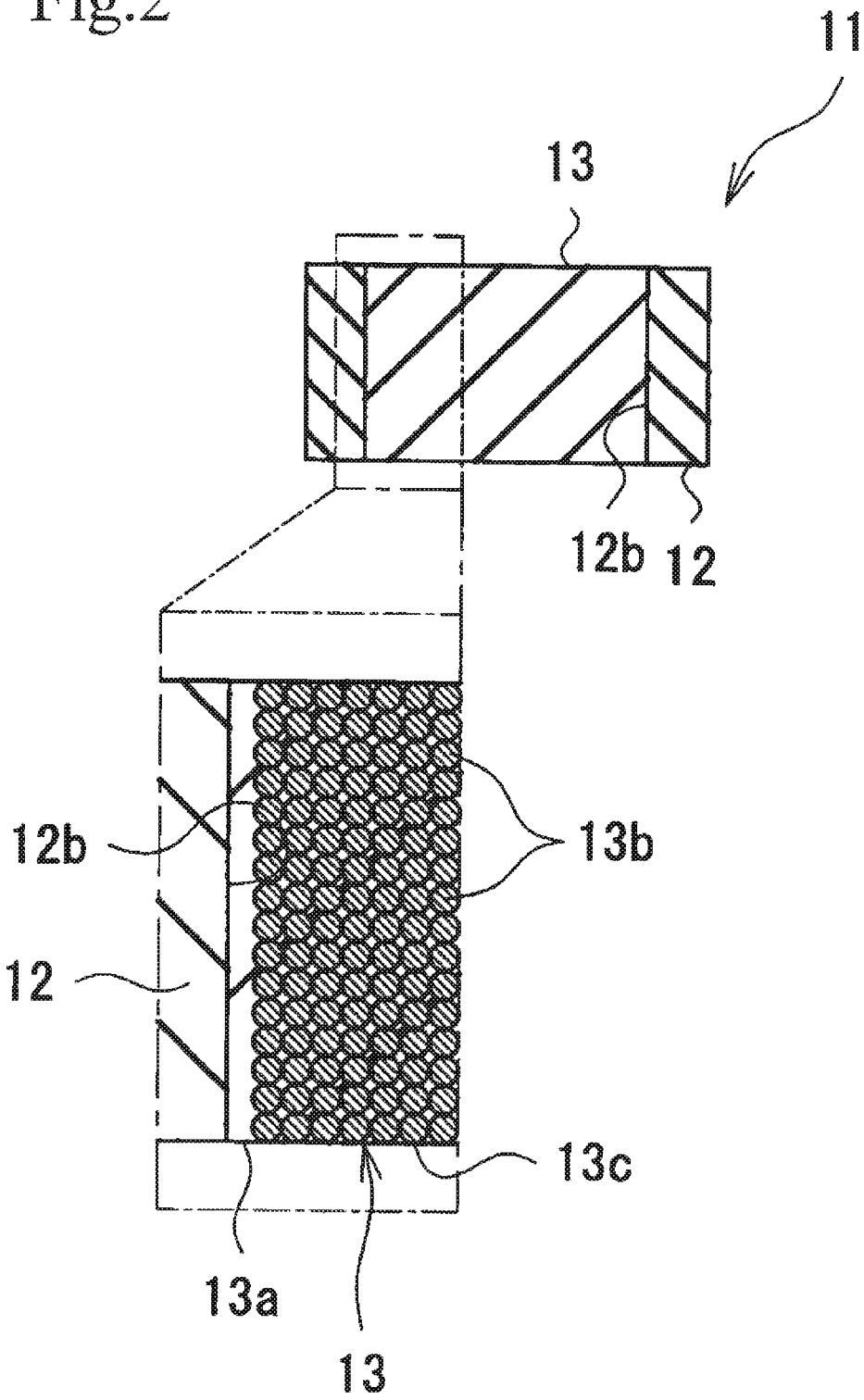
FIG. 2 is a longitudinal cross sectional view illustrating the elastic connector in the first embodiment.

Furthermore, as shown in FIG. 2, the conductive part 13 can also be formed so that the conductive bodies 13*b* are microscopically chained and oriented in the axial direction of the tube-like part 12 (current flow direction) in the rubber elastic body 13*a* and a current flow path 13*c* is formed.

As for the rubber elastic body 13*a*, a thermosetting rubber having rubber elasticity or a thermoplastic elastomer can be used. In particular, a thermosetting rubber that is a liquid before being cross-linked is preferable because the thermosetting rubber can be easily supplied into the hollow of the tube-like part 12. Exemplary materials of this type include, for example, liquid silicone rubber, liquid polyurethane rubber, liquid polyisobutylene rubber, and liquid polyacrylate rubber.

The rubber elastic body 13*a* is preferably made of the same material as the material of the tube-like part 12 in that a force with which the rubber elastic body 13*a* is attached to the tube-like part 12 is increased.

As for the conductive body 13*b*, a metal, a ceramic, carbon, and other conductive materials can be used. If a magnetic conductive body is used as the conductive body 13*b*, nickel, cobalt, iron, ferrite, or alloys including these materials at a high content can be used, for example. Other examples include: highly conductive metals, such as gold, silver, platinum, aluminum, nickel, copper, iron, palladium, cobalt, and chromium; alloys, such as stainless steel and brass; resins and insulative ceramics plated with magnetic conductive bodies; and magnetic conductive bodies plated with highly conductive metals. The conductive body 13*b* can be shaped like a particle, fiber, fine wire, or scale.

If a magnetic conductive body is used as the conductive body 13*b*, the conductive bodies 13*b* can be chained and oriented in the axial direction of the tube-like part 12 inside the rubber elastic body 13*a*. This is preferable in that the conductivity can be increased with a small number of conductive bodies 13*b* and the conductive part 13 can be softened.

The surface of the conductive body 13*b* is preferably subjected to surface treatment to increase a force with which the conductive body 13*b* and rubber elastic body 13*a* are attached to each other. For example, the surface of the conductive body 13*b* can be treated with a coupling agent such as a silane coupling agent.

In specific methods, a coupling agent is dispersed to the conductive bodies 13*b* in advance (wet method or dry method), and a coupling agent is added when the rubber elastic body 13*a* and conductive bodies 13*b* are mixed together (integral blend method).

An example of a method of manufacturing the elastic connector 11 will be described.

Figure 3:
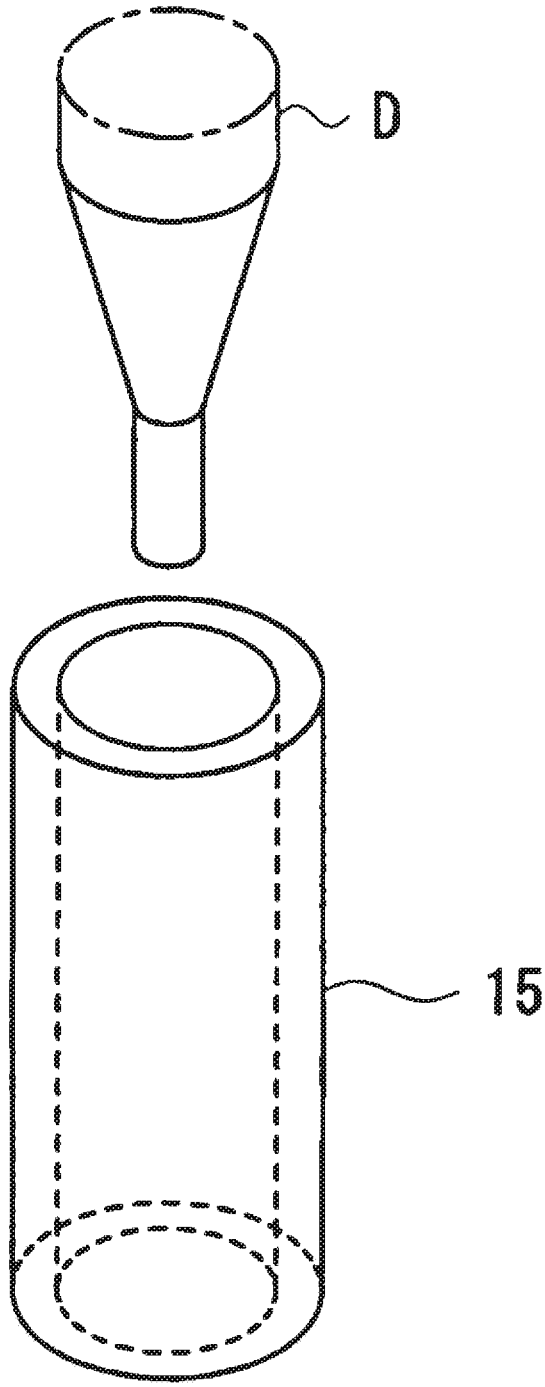
FIG. 3 illustrates a process of manufacturing the elastic connector in the first embodiment.

First, magnetic conductive bodies, which are the conductive bodies 13*b*, are blended into a liquid thermosetting rubber, which is the rubber elastic body 13*a*, in a state in which it is not hardened (solidified) to obtain a conductive member 14, from which the conductive part 13 is formed later. As shown in FIG. 3, the conductive member 14 is supplied into the hollow of an elongated rubber tube 15 from one end through a dispenser D. If the other end of the rubber tube 15 is blocked by being narrowed or with, for example, release coated paper or release tape (not shown), the conductive member 14 can be made hard to leak from the rubber tube 15. Although the rubber tube 15 can be manufactured by extrusion through a projected opening having a shape that matches the cross sectional shape of the rubber tube 15, followed by hardening, a commercially available rubber tube can also be used.

Figure 4:
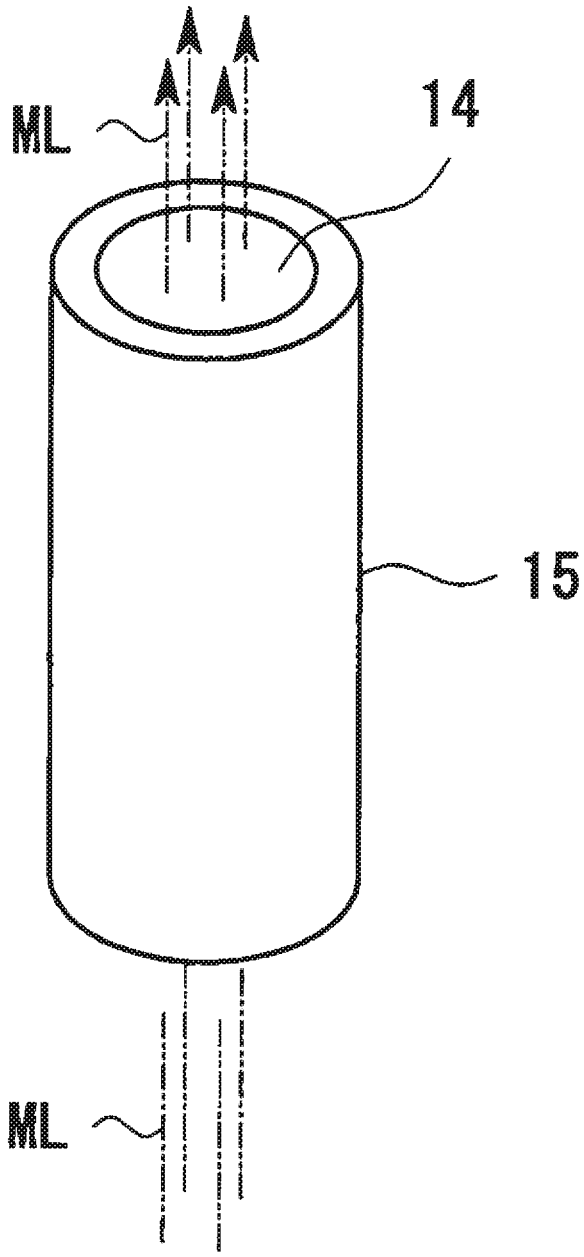
FIG. 4 illustrates a process of manufacturing the elastic connector in the first embodiment.

Next, the current flow path 13*c* (see FIG. 2) is formed by applying a magnetic field, in which magnetic lines MLs of force are oriented in the axial direction of the rubber tube 15, to the rubber tube 15 filled with the conductive member 14, as shown in FIG. 4, so that the conductive bodies 13*b* are chained and oriented along the axial direction of the rubber tube 15, after which the conductive part 13 is formed by heating the conductive member 14 so that the thermosetting rubber undergoes cross linking and is hardened (solidified). Thus, a major-axis columnar body 16 is formed, which has the conductive part 13 inside the tube-like part formed of the rubber tube 15.

As the strength of the magnetic field used to orient the conductive bodies 13*b*, the magnetic flux density is preferably 0.01 T or more. If the magnetic flux density is less than 0.01 T, the conductive bodies 13*b* extending from one end of the rubber tube 15 to the other end becomes hard to orient, preventing the current flow path 13*c* from being reliably formed. The magnetic flux density is more preferably from 0.1 T to 20 T. This is because if the magnetic flux density is 0.1 T or more, the efficiency with which the conductive bodies 13*b* are oriented can be increased. Under a condition that the magnetic flux density exceeds 20 T, the magnetic field generating apparatus is expensive and the magnetic field is hard to generate in a stable manner, so a magnetic flux density exceeding 20 T is not practical in the manufacturing of the elastic connector.

If a conductive rubber is used for the conductive member 14, the conductive bodies 13*b* made of conductive carbon are mixed into the rubber elastic body 13*a* and supplied into the tube-like part 12 as described above before the rubber elastic body 13*a* is vulcanized, after which the rubber elastic body 13*a* is vulcanized (solidified) to obtain the conductive part 13.

Figure 5:
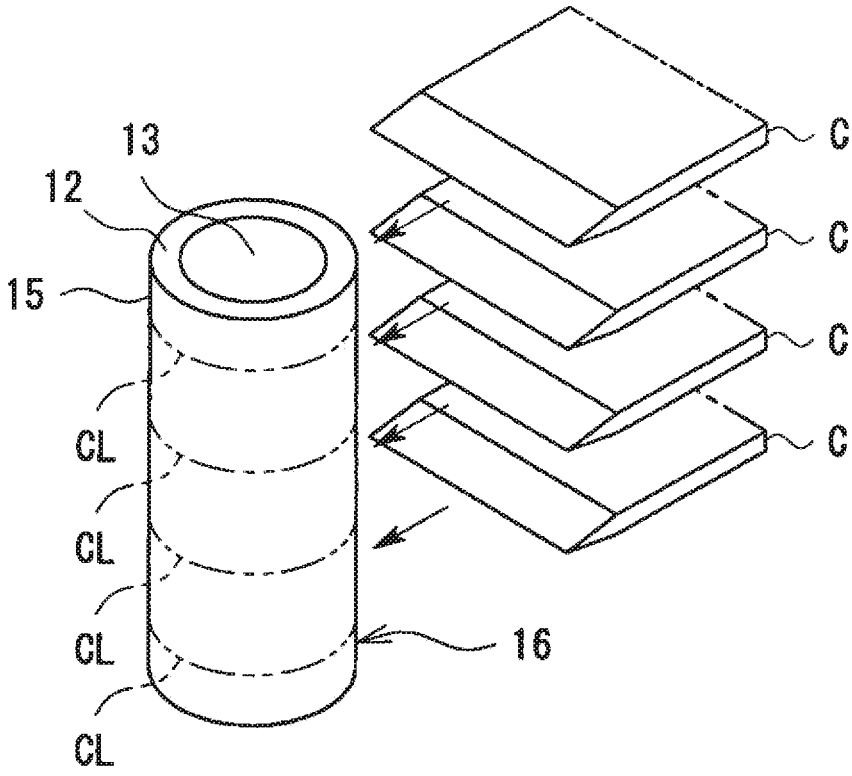
FIG. 5 illustrates a process of manufacturing the elastic connector in the first embodiment.
Figure 6:
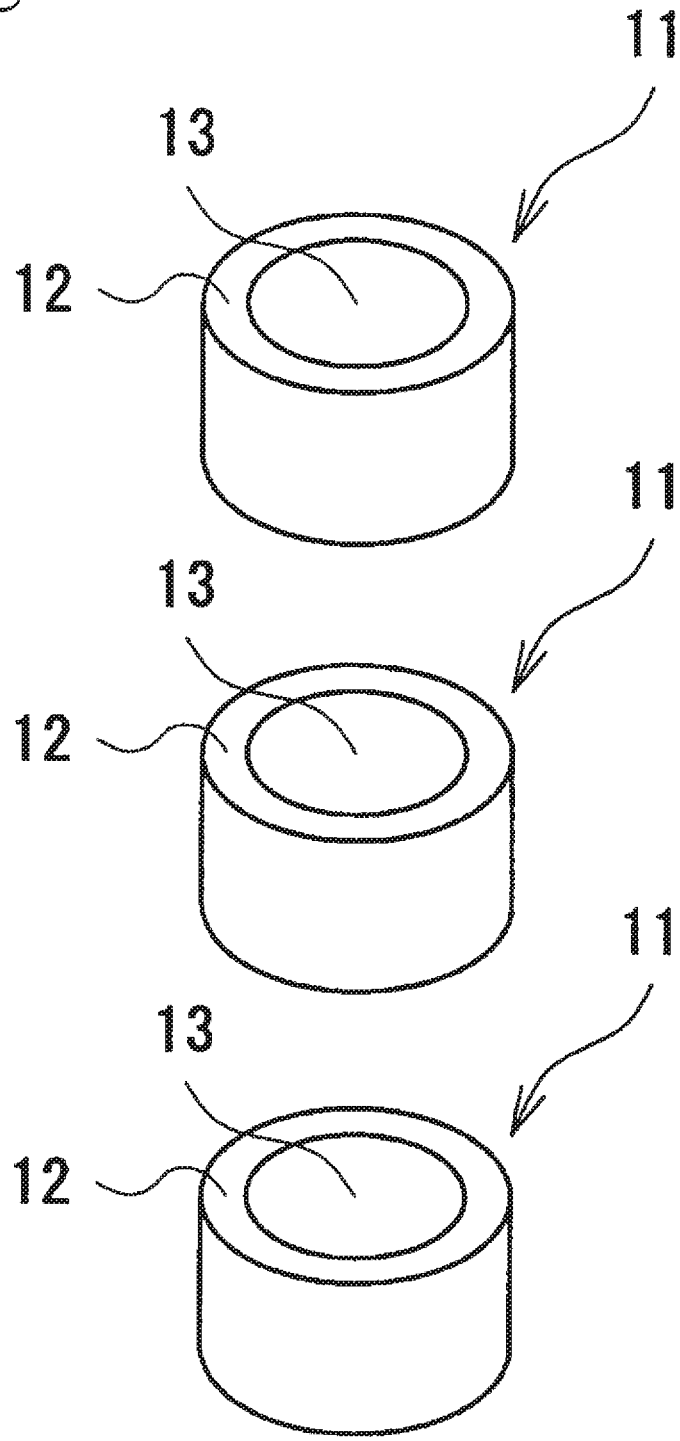
FIG. 6 illustrates a process of manufacturing the elastic connector in the first embodiment.

Finally, as shown in FIG. 5, a cutting process is carried out, in which the major-axis columnar body 16 is cut along a cutting line CL, which is perpendicular to the axial direction of the major-axis columnar body 16(crossing direction), with a cutting blade C to shorten the major-axis columnar body 16. Then, a plurality of elastic connectors 11, each of which is a minor-axis columnar body, are obtained as illustrated in FIG. 6.

Figure 7:
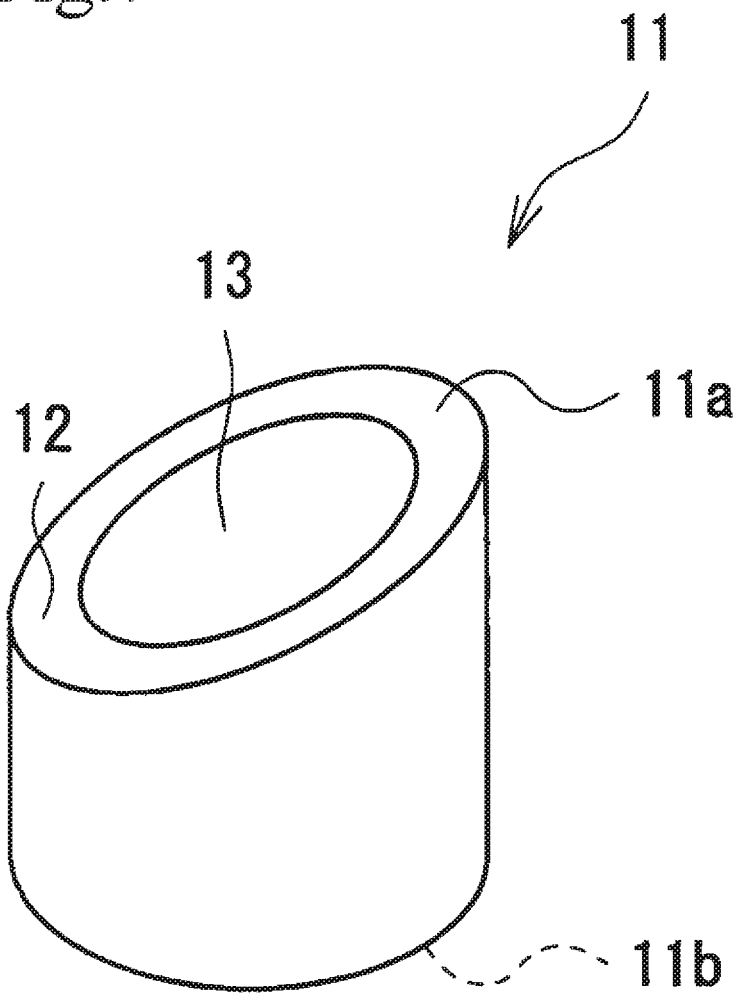
FIG. 7 is a perspective view illustrating a variation of the elastic connector in the first embodiment.
Figure 8:
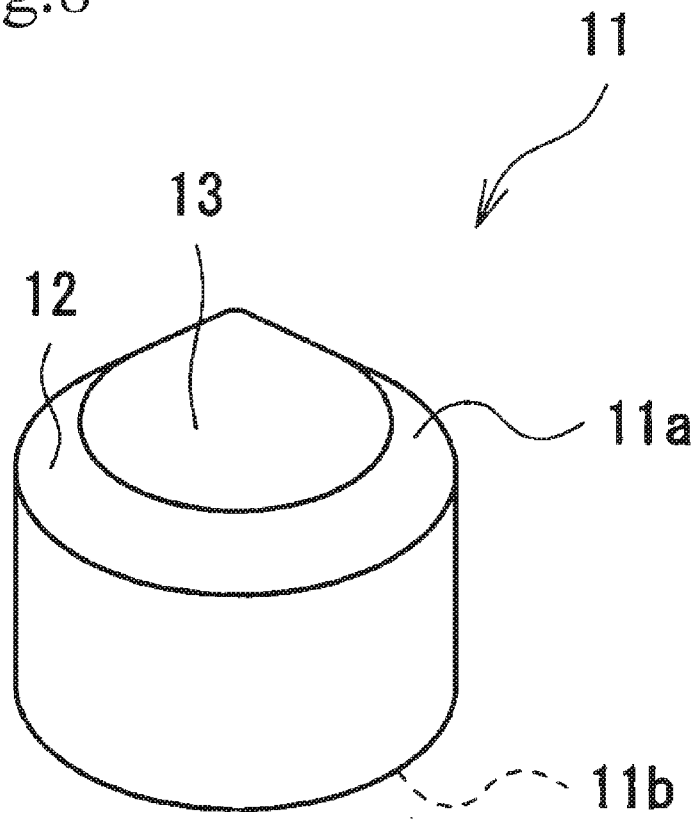
FIG. 8 is a perspective view illustrating another variation of the elastic connector in the first embodiment.

As for both ends 11*a* and 11*b* of the elastic connector 11, cut surfaces, which are cut in parallel to each other in a direction perpendicular to the axis of the tube-like part 12, have been illustrated as an example. However, as illustrated in FIG. 7, at least one of these cut surfaces can be formed as a flat inclined surface that is formed by being cut in a crossing direction angled with respect to the axial direction of the tube-like part 12. Furthermore, as illustrated in FIG. 8, the cut surface can be formed as a conical surface by being cut in a crossing direction angled with respect to the axial direction of the tube-like part 12. In these examples, since the end is shaped so as to be a cusp, a pressing load applied when the elastic connector 11 is pressed against the connection target member can be reduced. The form illustrated in FIG. 8, in which the conductive part 13 is exposed at the end, is better than the form illustrated in FIG. 7 because the conductive part 13 is reliably brought into contact with the connection target member.

Even if an end surface as described above is manufactured, since the inclined surface is formed after the current flow path 13*c* has been formed, the current flow path 13*c* extending along the axis of the tube-like part 12 and the inclined surface angled with respect to the axis of the tube-like part 12 can be easily obtained. By contrast, with the conventional technology in which molding is performed, a cavity surface, formed as an inclined surface, is angled with respect to the orientation of magnetic lines of force, so the strength of the magnetic lines of force, which are transmitted through the cavity, is likely to become uneven and thereby the current flowing path becomes hard to reliably form.

According to the elastic connector 11 and the method of manufacturing it, there is no need to use a different metal mold to manufacture each elastic connector 11; elastic connectors 11 having various required lengths can be easily obtained. There is also no need to create a new metal mold for each elastic connector 11 having a different length. An initial product can be quickly completed, reducing an initial cost. Furthermore, a plurality of elastic connectors 11 can be obtained from one major-axis columnar body 16, so production efficiency is high.

If the current flow path 13*c* is formed by chaining and orientating the conductive bodies 13*b*, the conductivity can be increased with a small number of blended conductive bodies 13*b* as compared with conductive rubber in which conductive bodies are evenly dispersed in a rubber elastic body, so the hardness of the conductive part 13 can be lowered. Accordingly, a pressing load applied when the elastic connector 11 is pressed against the connection target member can be reduced.

Second Embodiment

Elastic Connector Having a Cut Trace on the Tube-Like Part [FIGS. 9 to 13]

Figure 9:
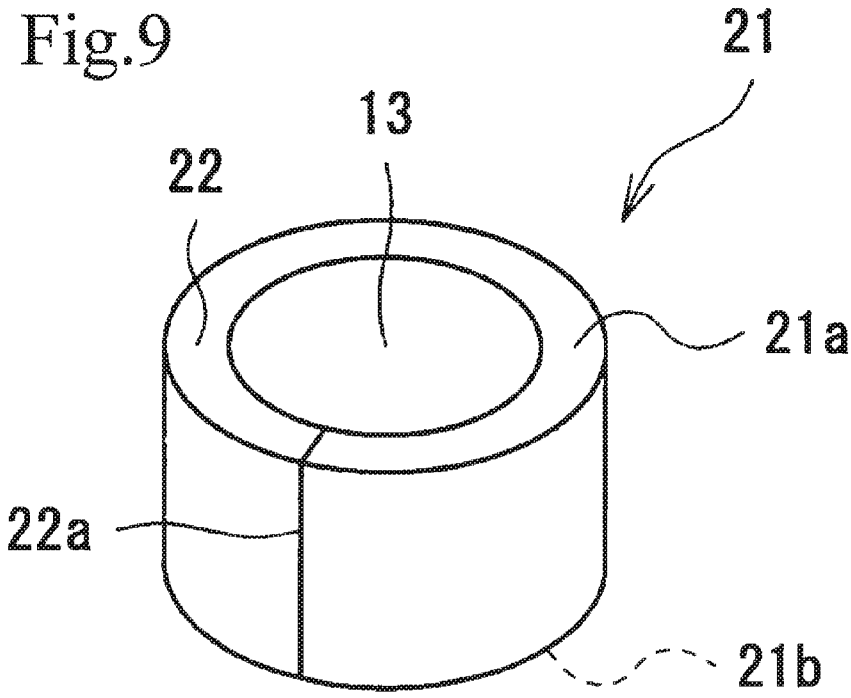
FIG. 9 is a perspective view of an elastic connector in a second embodiment.

FIG. 9 illustrates an example of an elastic connector 21 having a cut trace on the tube-like part.

The elastic connector 21 has one tube-like part and one conductive part, as with the elastic connector 11 described above. However, the elastic connector 21 has a cut trace 22*a*, on a tube-like part 22, which extends from its surface to the conductive part and also extends along the axial direction of the tube-like part 22.

The cut trace 22*a* is generated when the tube-like part 22 is cut in the axial direction of the tube-like part 22 with a cutting knife to pour a material used to form the conductive part 13 into the tube-like part 22. An annular holding force of the tube-like part 22, the cross section of which is annular, can be used to prevent a clearance from being generated in the cut trace 22*a*. However, the cut trace 22*a* may be filled with an adhesive to prevent the extrusion of the conductive part 13.

The elastic connector 21 is also a columnar body having the tube-like part 22 and the conductive part 13, both end surfaces 21*a* and 21*b* of which are cut surfaces.

The tube-like part 22 can be made of the same material as the tube-like part 12 of the elastic connector 11, described above, which lacks the cut trace 22*a*.

An example of manufacturing the elastic connector 21 will be described.

Figure 10:
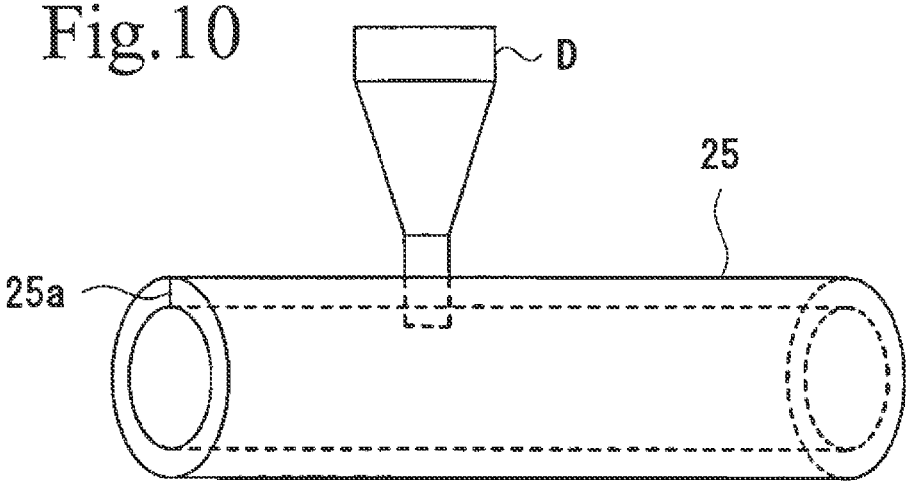
FIG. 10 illustrates a process of manufacturing the elastic connector in the second embodiment.

First, an incision 25*a* is made on a rubber tube 25, the incision 25*a* extending from the surface of the rubber tube 25 to the hollow inside it and also extending along the axial direction of the rubber tube 25. The end of the dispenser D is then inserted into the incision 25*a* as illustrated in FIG. 10 to supply the conductive member 14 into the hollow of the rubber tube 25. When the dispenser D is removed from the incision 25*a* upon completion of the supply, the incision 25*a* is closed by rubber elasticity.

Figure 11:
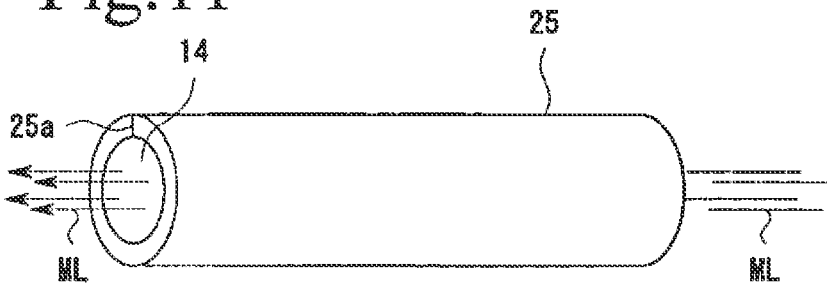
FIG. 11 illustrates a process of manufacturing the elastic connector in the second embodiment.

Next, as illustrated in FIG. 11, the current flow path 13*c* (see FIG. 2) is formed by applying a magnetic field, in which magnetic lines MLs of force are oriented in the axial direction of the rubber tube 25, to the rubber tube 25 filled with the conductive member 14, so that the conductive bodies 13*b* are chained and oriented along the axial direction of the rubber tube 25. The conductive part 13 is then formed by heating the liquid rubber in the conductive member 14 to harden (solidify) the liquid rubber. Thus, a major-axis columnar body 26 having the conductive part 13 inside the rubber tube 25 is formed. The incision 25*a* is left on the major-axis columnar body 26 as a cut tract 26*a*.

Figure 12:
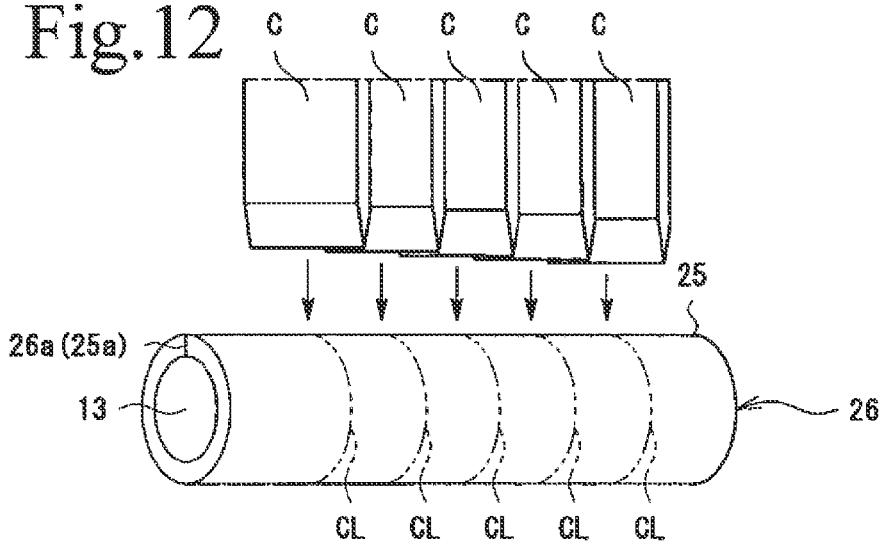
FIG. 12 illustrates a process of manufacturing the elastic connector in the second embodiment.
Figure 13:
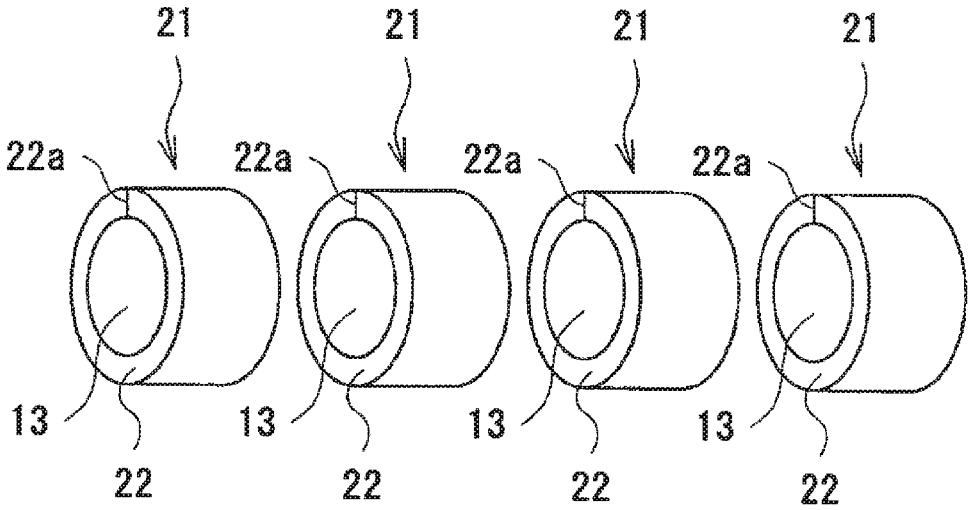
FIG. 13 illustrates a process of manufacturing the elastic connector in the second embodiment.

Finally, as shown in FIG. 12, the major-axis columnar body 26 is cut along the cutting line CL, which is perpendicular to the axial direction of the major-axis columnar body (crossing direction), with the cutting blade C to shorten the major-axis columnar body 26. Then, a plurality of elastic connectors 21, each of which is a minor-axis columnar body, are obtained as illustrated in FIG. 13.

The material of the rubber tube 25 is the same as the material used to form the elastic connector 11.

According to the elastic connector 21 and the method of manufacturing it, even if it is difficult to supply the conductive member 14 from an opening end of the rubber tube 25, for example, the rubber tube 25 is as long as 30 cm or more long, or even if the conductive member 14 has high viscosity, the conductive member 14 can be easily supplied.

After the conductive member 14 has been supplied, the step of solidifying the conductive member and the step of forming cut surfaces can be carried out in succession.

Third Embodiment

Figure 14:
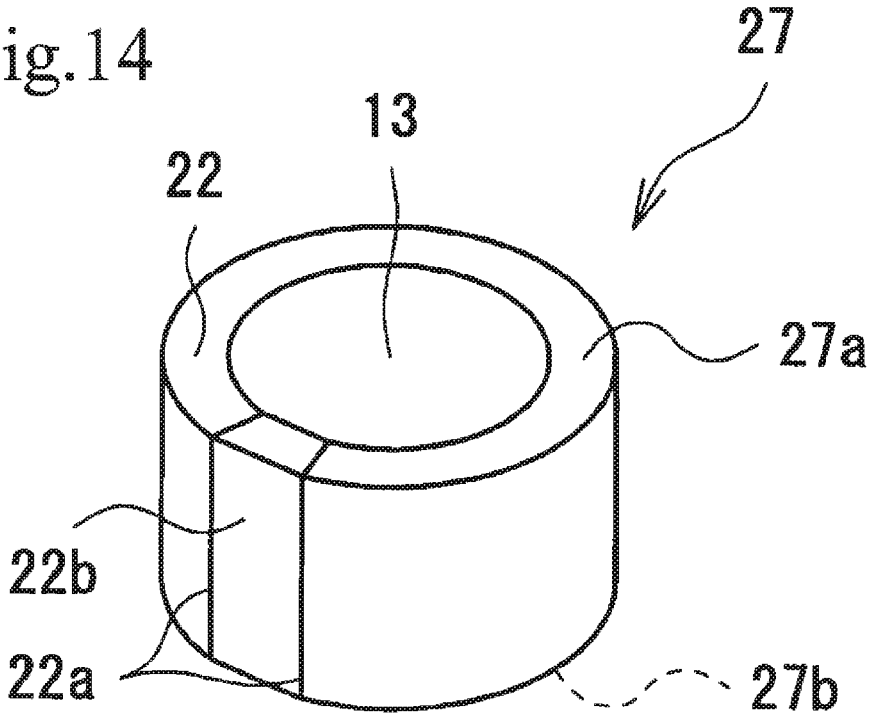
FIG. 14 is a perspective view of an elastic connector in a third embodiment.
Figure 15:
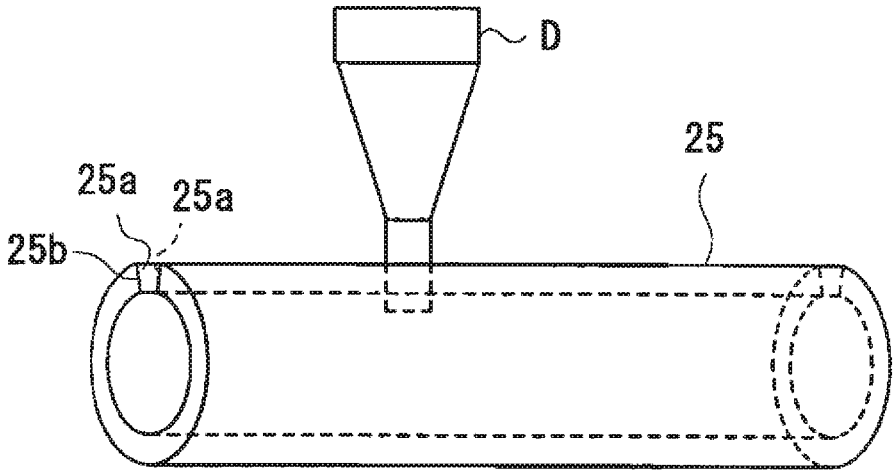
FIG. 15 illustrates a process of manufacturing the elastic connector in the third embodiment.
Figure 16:
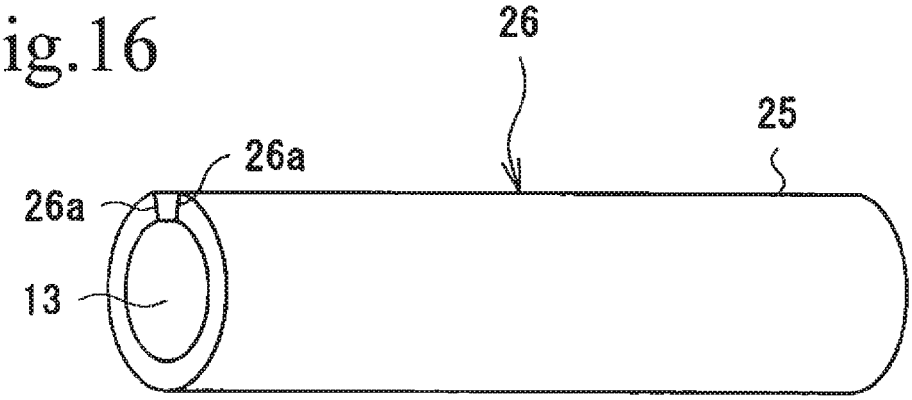
FIG. 16 illustrates a process of manufacturing the elastic connector in the third embodiment.

Elastic Connector Having Two Cut Traces on the Tube-Like Part [FIGS. 14 to 16]

FIG. 14 illustrates an example of an elastic connector 27 having a plurality of cut traces 22*a* and 22*a* on the tube-like part.

The elastic connector 27 has one more cut trace 22*a* as compared with the elastic connector 21 described above. The two cut traces 22*a* and 22*a* are also the trace of an opening formed when the conductive part 13 is formed inside the tube-like part 22. When the opening is large, part of the rubber tube 25 comes off and the two cut traces 22*a* and 22*a* are formed. A cutting 22*b* between the two cut traces 22*a* and 22*a* can be filled with a rubber elastic body.

In the manufacturing of the elastic connector 27, the cutting 22*b*, which comes off from the rubber tube 25 when the incisions 25*a* and 25*a* are formed on the rubber tube 25 with a cutting blade, needs to be removed from the rubber tube 25. After that, the elastic connector 27 can be manufactured in the same way as for the elastic connector 21 having one cut trace 22*a*, for example, by supplying the conductive member 14 into the hollow of the rubber tube 25 as illustrated in FIG. 15. It is also possible to fill an opening 25*b* formed in the tube-like part 22 due to the cutting 22*b* with a rubber elastic body as illustrated in FIG. 16.

The material of the tube-like part is the same as the material that has been used for the elastic connector 11 and the like.

As for the elastic connector 27 and the method of manufacturing it, since the cutting 22*b* in the tube-like part 22 is formed by the two cut traces 22*a* and 22*a*, the conductive member 14 can be easily supplied from the side surface of the tube-like part 22, enabling the elastic connector 27 to be more easily manufactured.

When the cutting 22*b* in the tube-like part 22 is filled, it is possible to prevent a drop from the tube-like part 22 and an extrusion of the conductive part 13 from the cutting 22*b* and enhance the holding stability of the elastic connector 27.

Fourth Embodiment

Elastic Connector Having a Plurality of Tube-Like Parts (1) [FIGS. 17 to 21]

Figure 17:
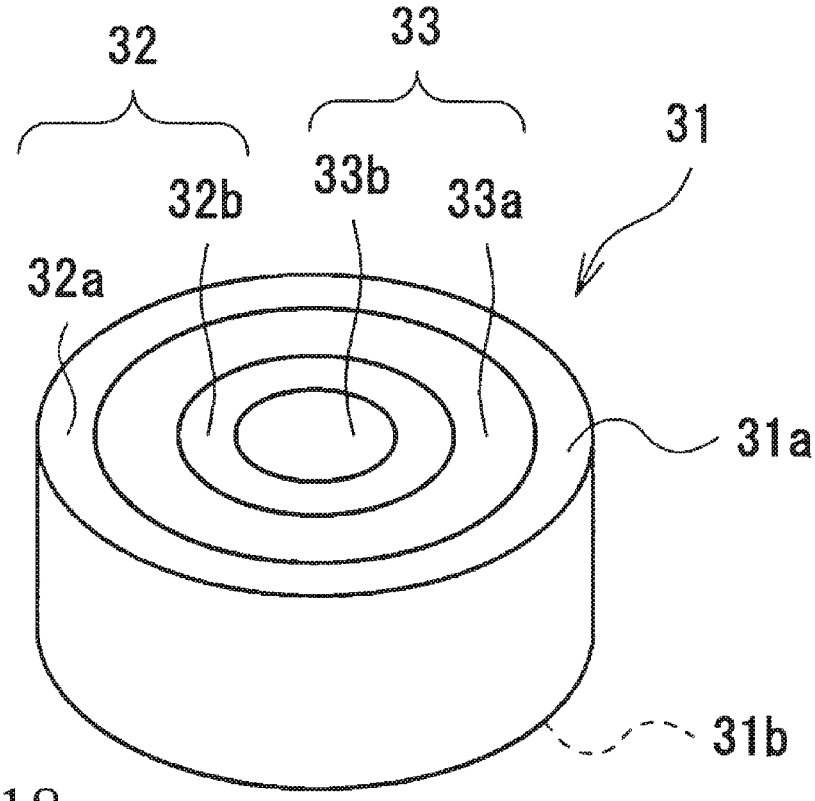
FIG. 17 is a perspective view of an elastic connector in a fourth embodiment.

FIG. 17 illustrates an example of an elastic connector 31 having a plurality of concentric tube-like parts.

The elastic connector 31 has two tube-like parts 32, which are an outer tube-like part 32*a* exposed to the outside and a small-diameter tube-like part 32*b* disposed inside the outer tube-like part 32*a* and embedded into the outer tube-like part 32*a*, the small-diameter tube-like part 32*b* having the same axial direction of the outer tube-like part 32*a* and the axial core as the outer tube-like part 32*a*. The elastic connector 31 also has two conductive parts 33, which are an intertube conductive part 33*a* provided between the outer tube-like part 32*a* and the small-diameter tube-like part 32*b* and an intratube conductive part 33*b* disposed inside the small-diameter tube-like part 32*b*.

The elastic connector 31 of this type is a columnar body having the tube-like parts 32 and conductive parts 33, both end surface 31*a* and 31*b* of which are cut surfaces.

The materials of the tube-like parts and conductive parts are the same as the materials that have been used for the elastic connector 11 and the like.

An example of a method of manufacturing the elastic connector 31 will be described.

Figure 18:
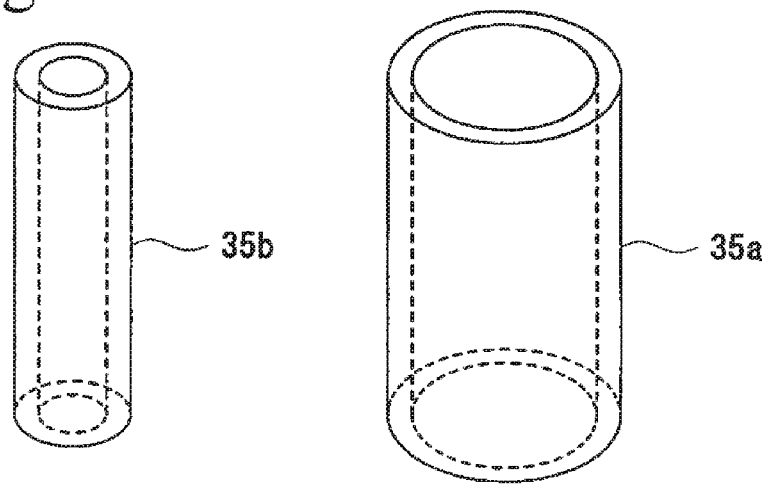
FIG. 18 illustrates a process of manufacturing the elastic connector in the fourth embodiment.
Figure 19:
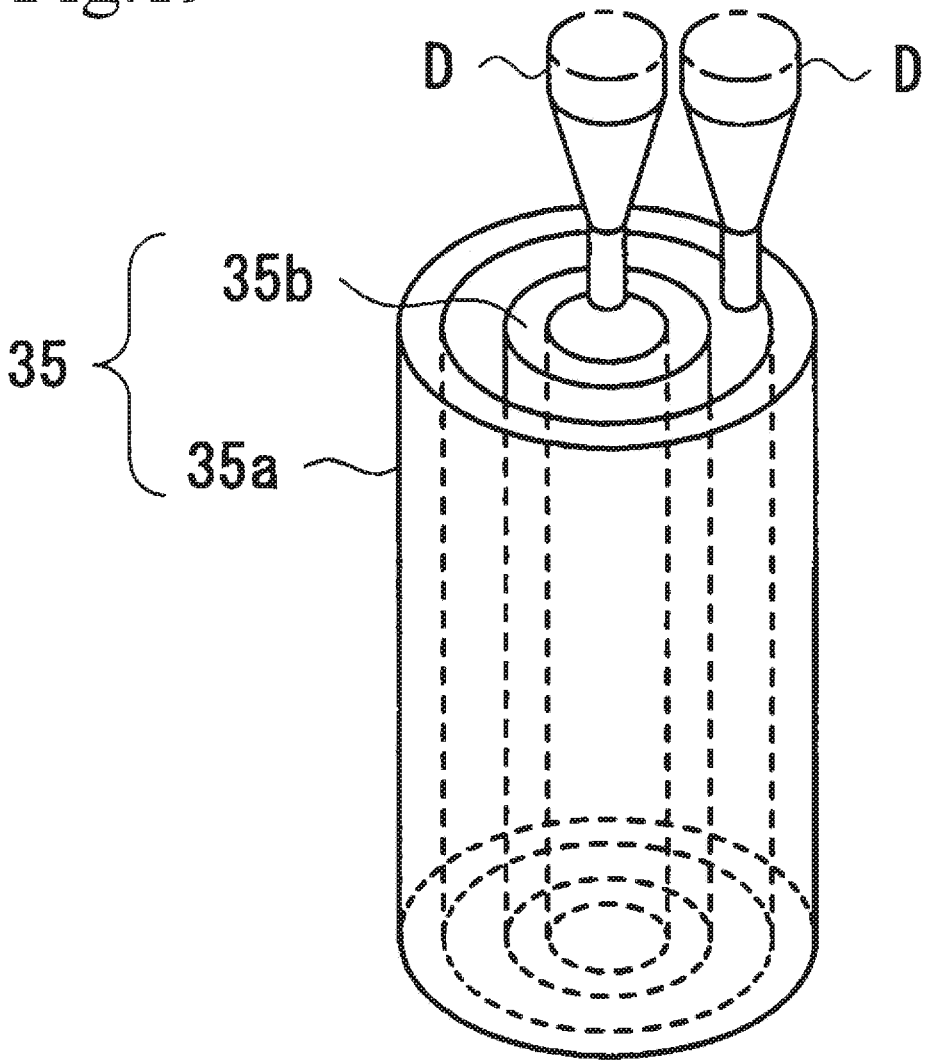
FIG. 19 illustrates a process of manufacturing the elastic connector in the fourth embodiment.
Figure 20:
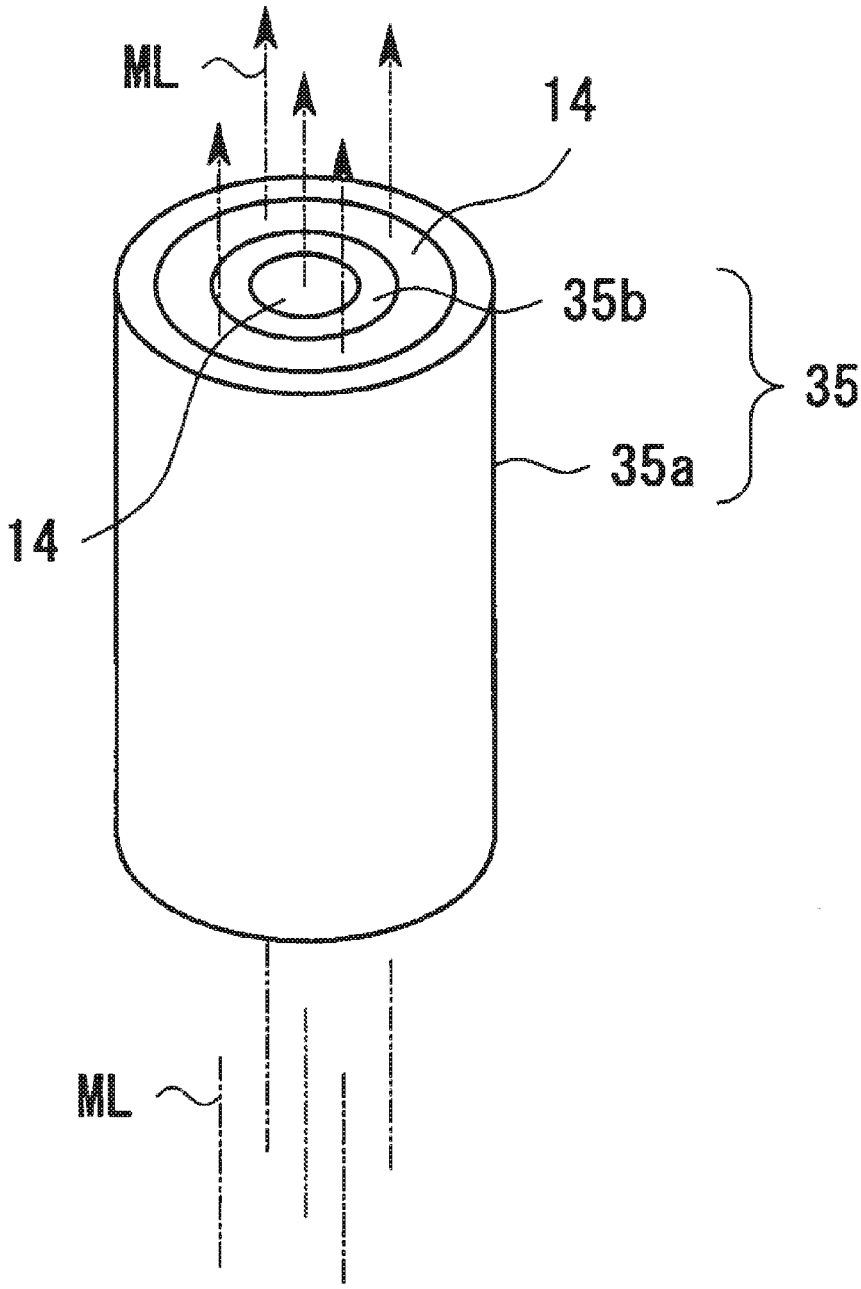
FIG. 20 illustrates a process of manufacturing the elastic connector in the fourth embodiment.
Figure 21:
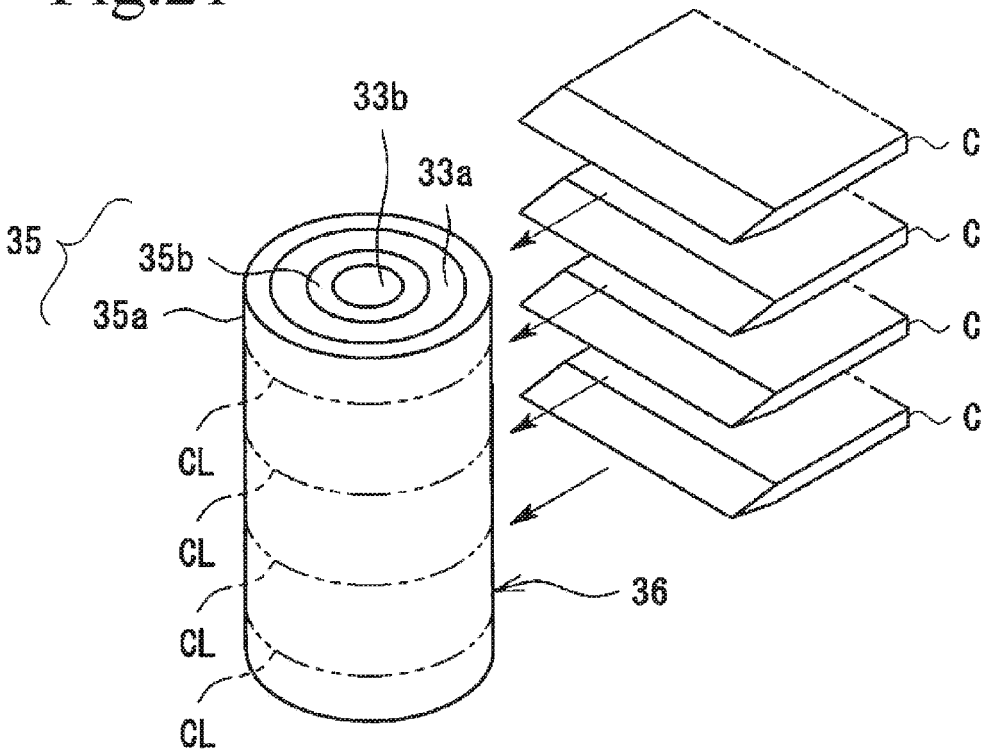
FIG. 21 illustrates a process of manufacturing the elastic connector in the fourth embodiment.

First, a large-diameter rubber tube 35*a* and a small-diameter rubber tube 35*b* as shown in FIG. 18 are prepared, and the small-diameter rubber tube 35*b* is inserted into the large-diameter rubber tube 35*a* with the axis cores of the two rubber tubes being matched to form a double-layer tube 35. As illustrated in FIG. 19, the conductive member 14 is then supplied into the clearance between the large-diameter rubber tube 35*a* and the small-diameter rubber tube 35*b* and into the hollow inside the small-diameter rubber tube 35*b* from one end of the double-layer tube 35 by using the dispenser D. After that, a magnetic field is applied to form current flow paths, as illustrated in FIG. 20, in the same way as for the elastic connector 11 described above and the like, and the liquid rubber is heated and hardened (solidified) to obtain a major-axis columnar body 36. The major-axis columnar body 36 is cut with the cutting blade C to obtain a plurality of elastic connectors 31, which are minor-axis columnar bodies, as illustrated in FIG. 21.

According to the elastic connector 31 and the method of manufacturing it, since the two conductive parts 33*a* and 33*b* are provided in the axial direction of the tube-like part 32, connection target members are electrically connected surely to each other, enabling the elastic connector 31 having high reliability in electric connection to be achieved. Furthermore, the two conductive parts 33*a* and 33*b* can also be electrically connected to connection target members that each have two different electrodes; for example, the inter-tube conductive part 33*a* is connected to a positive electrode and the intra-tube conductive part 33*b* is connected to a negative electrode.

Although FIG. 17 illustrates an example in which one small-diameter tube-like part 32*b* is provided, it is also possible to have a structure in which a small-diameter tube-like part (not shown) having a smaller diameter is provided inside the small-diameter tube-like part 32*b*.

Fifth Embodiment

Figure 22:
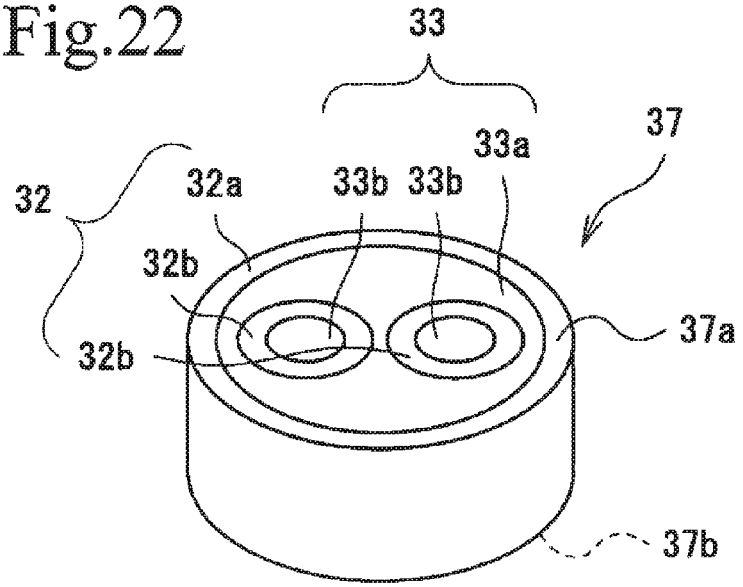
FIG. 22 is a perspective view of an elastic connector in a fifth embodiment.

Elastic Connector Having a Plurality of Tube-Like Parts (2) [FIG. 22]

FIG. 22 illustrates an example of an elastic connector 37 having a plurality of tube-like parts that are not concentric.

The elastic connector 37 has a total of three tube-like parts 32, which are an outer tube-like part 32*a* exposed to the outside and two small-diameter tube-like parts 32*b* and 32*b* embedded inside the outer tube-like part 32*a*. The elastic connector 37 also has two conductive parts 33, which are the inter-tube conductive part 33*a* provided between the outer tube-like part 32*a* and the small-diameter tube-like part 32*b* and the intra-tube conductive part 33*b* disposed inside the small-diameter tube-like part 32*b*. The elastic connector 37 of this type is a columnar body having three tube-like parts 32 and two conductive parts 33, both end surface 37*a* and 37*b* of which are cut surfaces.

The elastic connector 37 can also be manufactured by using the same materials as the materials used for the elastic connector 31 described above.

If the outer tube-like part 32*a* and small-diameter tube-like part 32*b* are combined together as in the case of the elastic connector 37, the cut surfaces of the tube-like part 32 and conductive part 33, which are exposed on both end surfaces 37*a* and 37*b* of the elastic connector 37, can have various shapes. This ensures an electric connection even for a connection target member having a complex electrode placement.

Although FIG. 22 illustrates an example in which two small-diameter tube-like parts 32*b* are provided, it is also possible to provide more small-diameter tube-like parts 32*b*. If, for example, an elastic connector having the intra-tube conductive part 33*b* disposed inside the small-diameter tube-like part 32*b* is manufactured, and a plurality of elastic connectors of this type are combined and placed in the outer tube-like part 32*a* having a large diameter, then an elastic connector (not shown) having a plurality of conductive parts 13 can be easily obtained. In this example, the elastic connector can be completed just by inserting a plurality of elastic connectors, each of which has the small-diameter tube-like part 32*b* disposed inside the outer tube-like part 32*a* without having to providing the inter-tube conductive part 33*a*.

Sixth Embodiment

Figure 23:
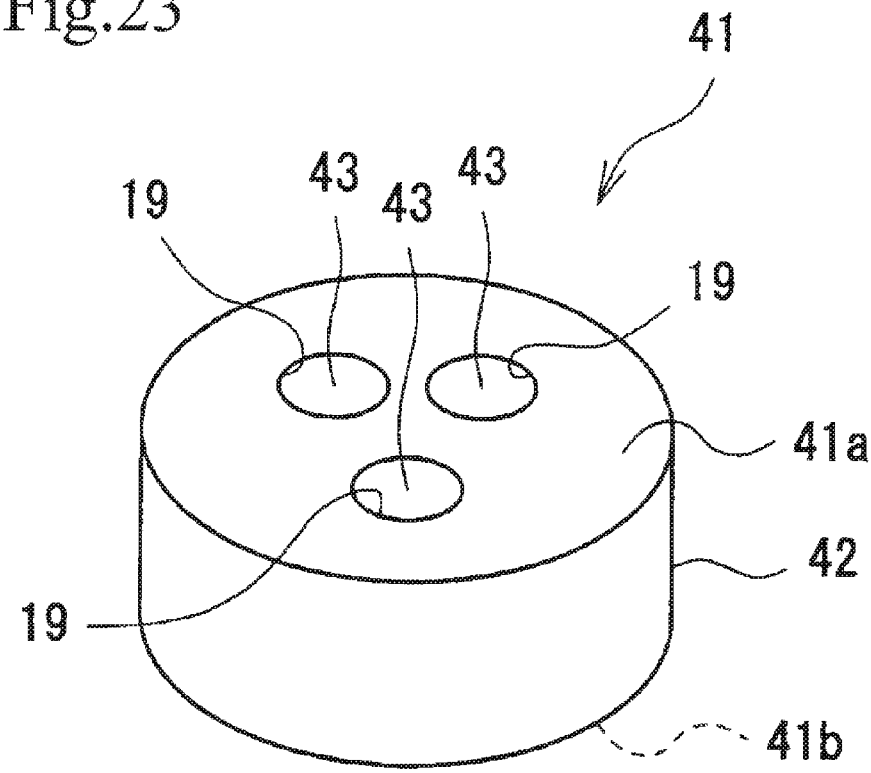
FIG. 23 is a perspective view of an elastic connector in a sixth embodiment.

Elastic Connector Having a Plurality of Conductive Parts in One Tube-Like Part [FIG. 23]

FIG. 23 illustrates an example of an elastic connector 41 having a plurality of conductive parts in one tube-like part.

The elastic connector 41 is formed so that three through-holes 19 are formed in one tube-like part 42; conductive parts 43 are formed in such a way that the three through-holes 19 are filled with the conductive parts 43. The elastic connector 41 is also a columnar body, both end surfaces 41*a* and 41*b* of which are cut surfaces. The materials of the tube-like part and conductive parts are the same as the materials in the other examples.

An example of a method of manufacturing the elastic connector 41 will be described. First, a three-hole rubber tube having three holes, which is extendable in the axial direction of the tube-like part 42, is prepared, and a liquid conductive member in which magnetic conductive bodies are blended is supplied into the inside of the three holes from one end of the three-hole rubber tube by using a dispenser. A magnetic field, in which magnetic lines of force are oriented in the axial direction of the tube-like part 42, is then applied to the three-hole rubber tube filled with the conductive member to form current flow paths of the magnetic conductive bodies (see FIG. 2), after which the conductive member is heated and hardened to obtain a major-axis columnar body. Finally, the major-axis columnar body is cut with a cutting blade along cutting lines perpendicular (crossing direction) to the axis of the major-axis columnar body to obtain a plurality of elastic connectors 41, each of which is a minor-axis columnar body.

According to the elastic connector 41 and the method of manufacturing it, since the three conductive parts 43 are provided in the axial direction of the tube-like part 42, connection target members are electrically connected surely to each other, enabling the elastic connector 41 having high reliability in electric connection to be achieved. It is also possible to electrically connect connection target members having three different electrodes to each other.

Seventh Embodiment

Figure 24:
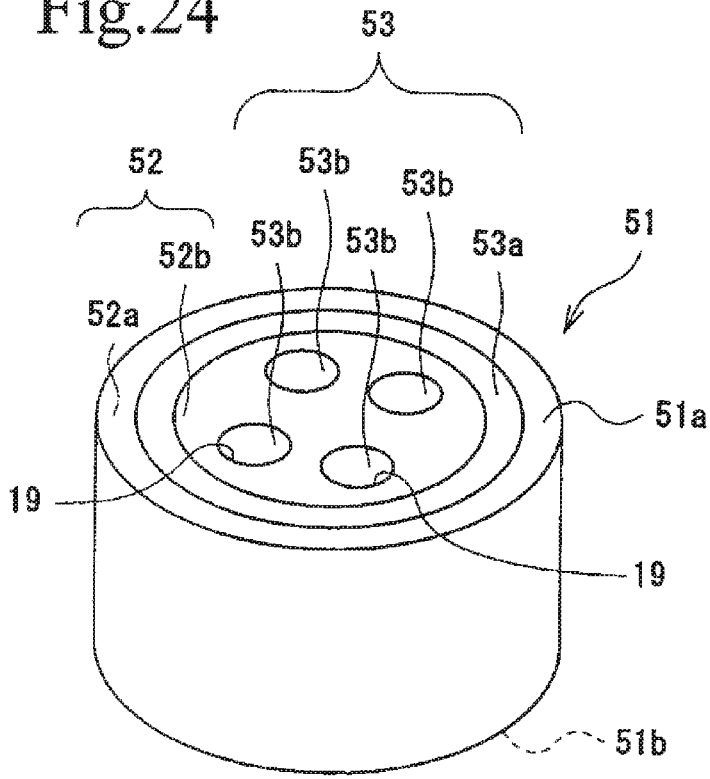
FIG. 24 is a perspective view of an elastic connector in a seventh embodiment.

Variation in which Various Tube-Like Parts are Combined [FIG. 24]

The elastic connectors 11, 21, 27, 31, 37, and 41, which have been described, can be modified as described below. That is, an elastic connector that combines the features of the above elastic connectors can be manufactured.

First, an elastic connector 51 that combines the tube-like parts used in the elastic connectors 11, 21, 27, 31, 37, and 41 is illustrated in FIG. 24.

A tube-like part 52 of the elastic connector 51 includes an outer tube-like part 52*a* and a small-diameter tube-like part 52*b*, having four through-holes 19, the outer diameter of which is smaller than the inner diameter of the outer tube-like part 52*a*. A conductive part 53 includes an inter-tube conductive part 53*a* formed by hardening the conductive member 14 between the outer tube-like part 52*a* and the small-diameter tube-like part 52*b* and four intra-tube conductive parts 53*b* formed by hardening the conductive member 14 disposed inside the small-diameter tube-like part 52*b*. The tube-like parts and conductive parts can be manufactured with the same materials as the materials used in the other examples in the same way as for the elastic connector 37 and the like.

According to the elastic connector 51 of this type, which has a plurality of conductive parts 53, and the method of manufacturing it, connection target members are electrically connected surely to each other, and reliability in electric connection can be thereby improved. It is also possible to electrically connect connection target members that each have a plurality of electrodes. Furthermore, it is possible to surely electrically connect connection target members that each have a complex electrode placement.

Although examples in which both end surfaces of a columnar body are inclined surfaces as shown in FIGS. 7 and 8 have been applied to the elastic connector 11, these examples can also be applied to the other elastic connectors. Similarly, although an example having one cut trace 22*a* has been described for the elastic connector 27 and an example having two cut traces 22*a* and 22*a* has been described for the elastic connector 21, one or two or more cut traces can be formed in other elastic connectors.

In addition to rubber tubes with openings at both ends, rubber tubes with an opening at one side (with one side closed) can be used.

Examples in which conductive rubber is used as the conductive member 14, which becomes the conductive part 13 can be applied to various elastic connectors.

Both end surfaces of the major-axis columnar body are cut along the cutting line CL, and the cut ends are usually discarded. The cut ends can also be used as columnar bodies having a cut surface at only one end.

Eight Embodiment

Examples of Using an Elastic Connector [FIGS. 25 to 28]

Some examples of using an elastic connector will be described below. Although the elastic connector 11 is used in these examples, the other elastic connectors described can also be used similarly.

Figure 25:
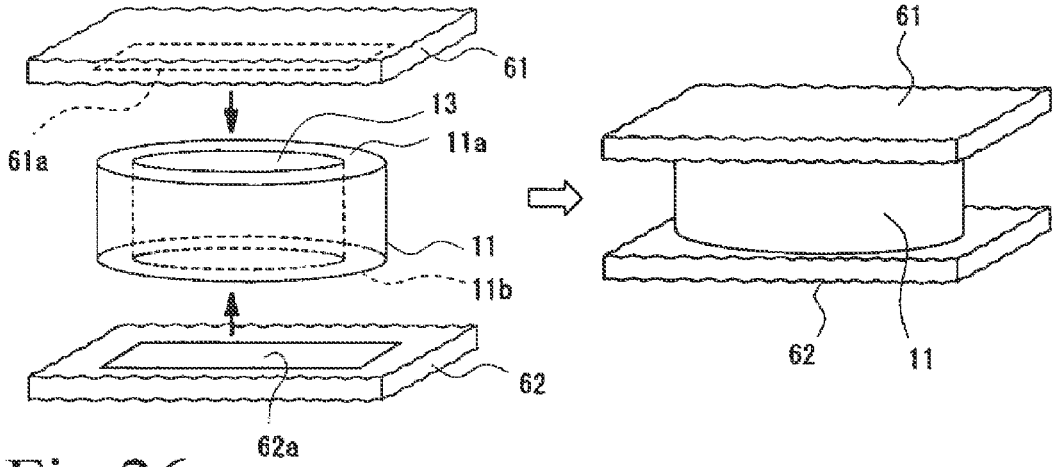
FIG. 25 illustrates an example of using an elastic connector.

First, FIG. 25 illustrates an example in which the elastic connector 11 is held by two connection target members 61 and 62, placed in parallel, therebetween.

In this example, the connection target member 61 having a contact 61*a* to which the end surface 11*a*, which is one end surface of the elastic connector 11, is connected and the connection target member 62 having a contact 62*a* to which the end surface 11*b*, which is another end surface of the elastic connector 11, is connected are placed in parallel. The connection target members 61 and 62 vertically hold the elastic connector 11 therebetween. Thus, the contact 61*a* of the connection target member 61 and the contact 62*a* of the connection target member 62 are electrically connected through the conductive part 13 of the elastic connector 11. Examples of the connection target members 61 and 62 include circuit boards.

Figure 26:
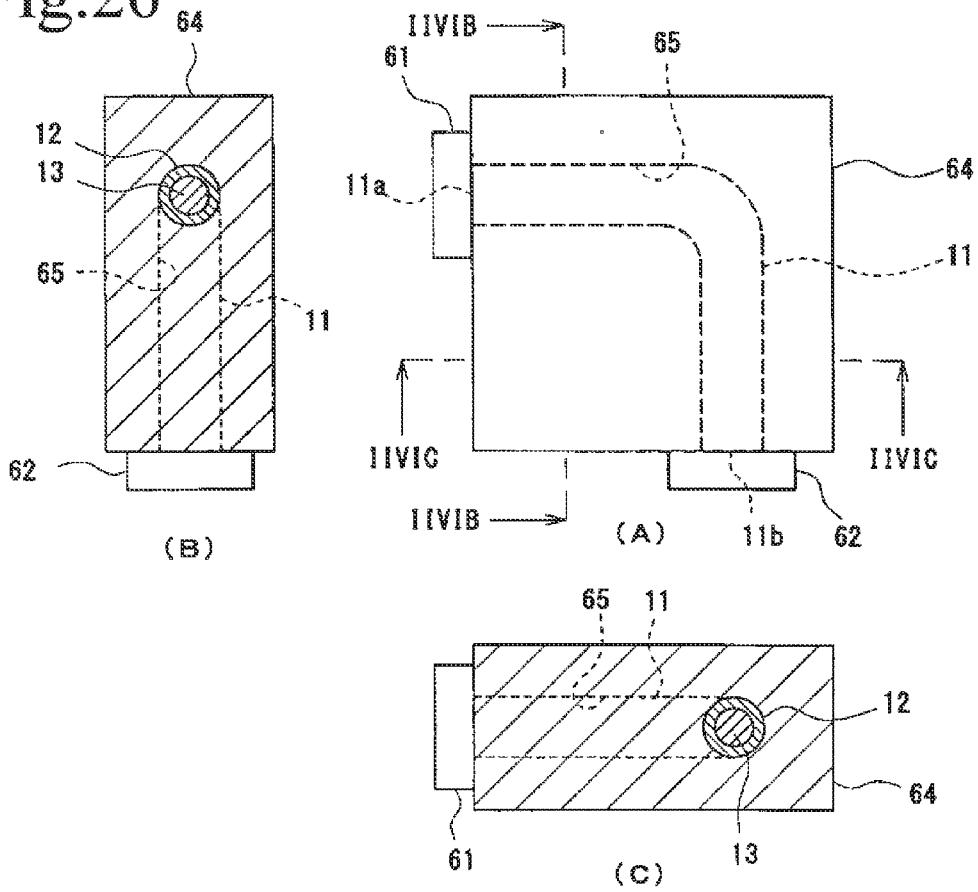
FIG. 26 illustrates another example of using an elastic connector.

Next, a connection example in which the connection target members 61 and 62 to which to connect the elastic connector 11 are not placed in parallel will be described. FIG. 26 illustrates an example in which the connection target members 61 and 62 are perpendicular to each other. Since, in this example, the two connection target members 61 and 62 cannot directly press the elastic connector 11, a connector auxiliary tool 64 is used.

The connector auxiliary tool 64 is formed so as to cover the elastic connector 11, which is bent at substantially right angles to form an L-shape, from the surrounding of the elastic connector 11, so the connector auxiliary tool 64 has an L-shaped hole 65 in which the elastic connector 11 is accommodated. The inner diameter of the hole 65 is slightly larger than the outer diameter of the elastic connector 11 so that the elastic connector 11 can be inserted into the hole 65. However, the hole 65 and elastic connector 11 need to be mutually in contact to an extent that when the ends of the elastic connector 11 protruding from the hole 65 are pressed by the connection target members 61 and 62, the elastic connector 11 itself is contracted and comes into contact with the connection target members 61 and 62. That is, the connector auxiliary tool 64 needs to hold the elastic connector 11 to an extent that when the ends of the elastic connector 11 that protrude from the hole 65 are pressed to positions at which each end becomes flush with the pertinent surface of the connector auxiliary tool 64, the elastic connector 11 has a pressing force exerted from the surface toward the outside. As the material of the connector auxiliary tool 64, various thermoplastic resins and thermosetting resins, which can be easily formed to a desired shape, can be used.

Although, in the above example, the elastic connector 11 is bent, the elastic connector 11 can have cut surfaces that are inclined so as to match the placements of the connection target members 61 and 62.

Figure 27:
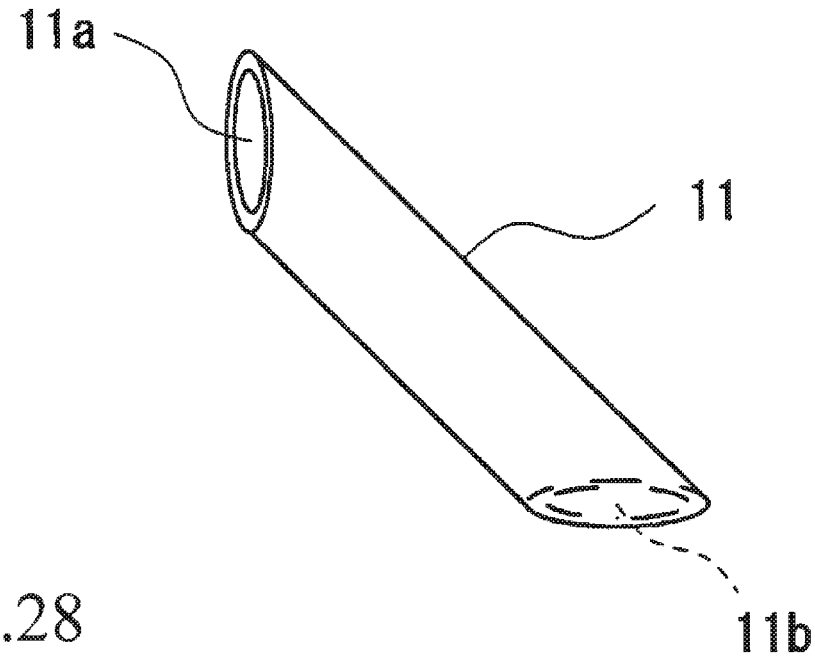
FIG. 27 is a perspective view of an elastic connector with an end surface cut at an angle.
Figure 28:
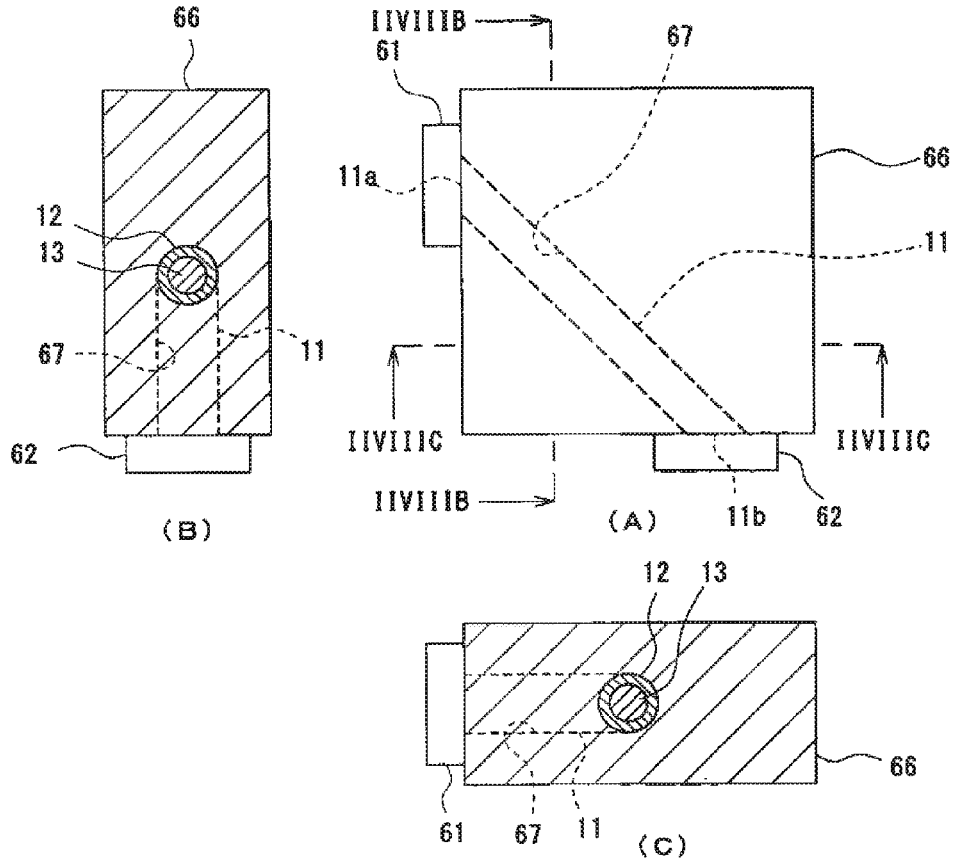
FIG. 28 illustrating another example of using an elastic connector.
Figure 29:
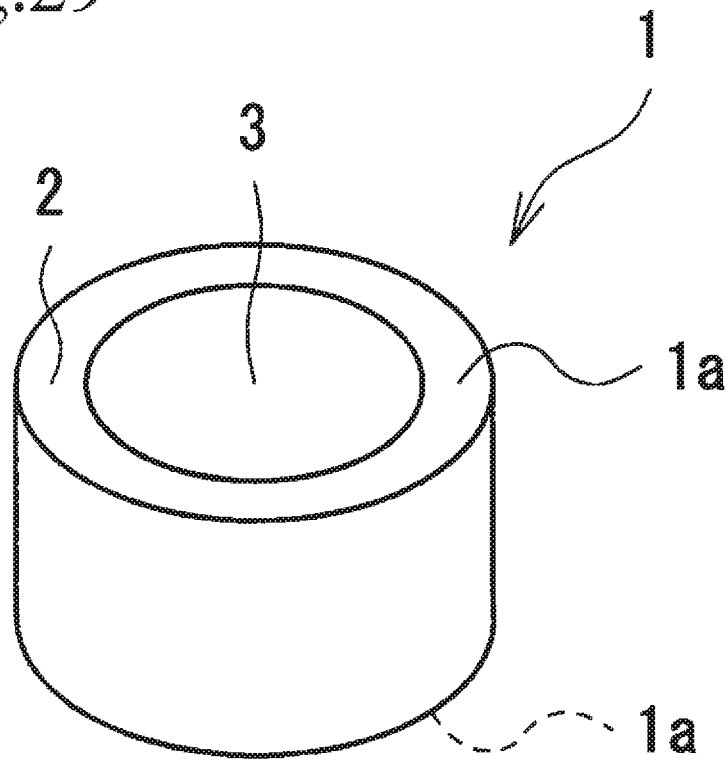
FIG. 29 is a perspective view of a conventional elastic connector.
Figure 30:
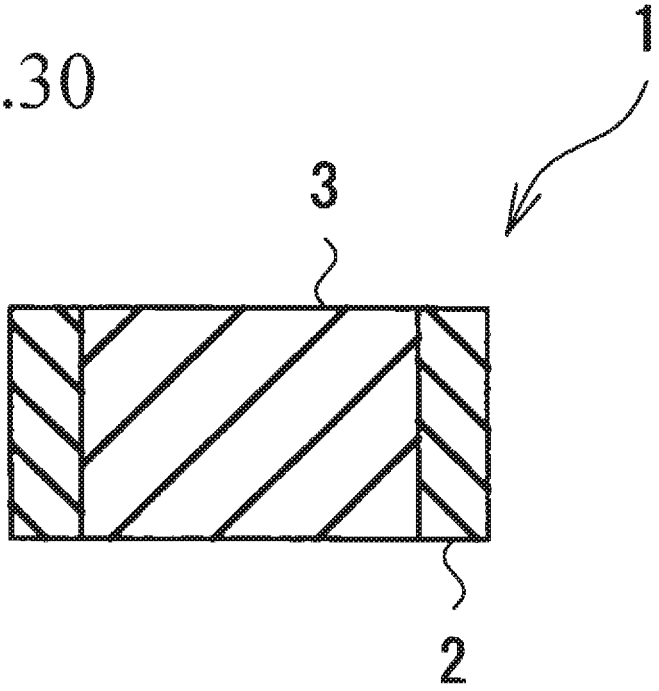
FIG. 30 is a longitudinal cross sectional view of the conventional elastic connector.

The elastic connector 11 illustrated in FIG. 27 has cut surfaces 11*a* and 11*b* formed by cutting ends at about 45 degrees with respect the axial direction of the elastic connector 11. FIG. 28 illustrates an example in which the elastic connector 11 of this type is used to electrically connect circuit boards to each other. In this example as well, a connector auxiliary tool 66, which accommodates the elastic connector 11 without its shape being altered, holds the elastic connector 11 and, even when its both ends surfaces 11*a* and 11*b* are pressed by the connection target members 61 and 62, the elastic connector 11 is pressed in a hole 67 formed in the connector auxiliary tool 66, so the connection target members 61 and 62 can be surely connected to the elastic connector 11. The connector auxiliary tool 66 can be manufactured by using the same material as for the connector auxiliary tool 64.

Although these connector auxiliary tools 64 and 66 can be accommodated in an electronic device by being formed in a shape that matches an accommodation spacing in the electronic device, the connector auxiliary tools 64 and 66 are fastened with double-sided adhesive tapes or screws as necessary.

In the examples in FIGS. 26 and 28, in which the connection target members 61 and 62 are not positioned in parallel, the elastic connector 11 has been held by the connector auxiliary tool 64 or 66. If, however, any part in a device is disposed at a position at which the part supports the elastic connector 11 so that the elastic connector is not displaced when the elastic connector 11 is pressed by the connection target members 61 and 62, even if the elastic connector 11 has a bent shape shown in FIG. 26 or has the inclined surfaces shown in FIGS. 27 and 28 as the end surfaces 11*a* and 11*b*, the elastic connector 11 can electrically connect the connection target members 61 and 62 without having to use the connector auxiliary tool 64 or 66.

REFERENCE SIGNS LIST

1 elastic connector (conventional technology)
  1*a* end surface
2 side circumferential part
3 elastic conductive part
11 elastic connector (first embodiment)
  11*a* end surface
  11*b* end surface
12 tube-like part

13 conductive part
13*a* rubber elastic body
13*b* conductive body (magnetic conductive body)
13*c* current flow path
14 conductive member
15 rubber tube
16 major-axis columnar body
19 through-hole
21 elastic connector (second embodiment)
21*a* end surface
21*b* end surface
22 tube-like part
22*a* cut trace
22*b* cutting
25 rubber tube
25*a* incision
25*b* opening
26 major-axis columnar body
26*a* cut trace
27 elastic connector (third embodiment)
31 elastic connector (fourth embodiment)
32 tube-like part
32*a* outer tube-like part
32*b* small-diameter tube-like art
33 conductive part
33*a* inter-tube conductive part
33*b* intra-tube conductive part
35 double-layer tube
35*a* large-diameter rubber tube
35*b* small-diameter rubber tube
36 major-axis columnar body
37 elastic connector (fifth embodiment)
41 elastic connector (sixth embodiment)
41*a* end surface
41*b* end surface
42 tube-like part
43 conductive part
51 elastic connector (seventh embodiment)
52 tube-like part
52*a* outer tube-like part
52*b* small-diameter tube-like part
53 conductive part
53*a* inter-tube conductive part
53*b* intra-tube conductive parts
C cutting blade
CL cutting line
D dispenser
ML magnetic line of force
61, 62 connection target member
61*a*, 62*a* end surface
61*b*, 62*b* end surface
64 connector auxiliary tool
65 hole
66 connector auxiliary tool
67 hole

The invention claimed is:

1. An elastic connector that is formed of a columnar body including an insulative tube-like part having rubber elasticity and a conductive part passing through the tube-like part in an axial direction of the tube-like part, different connection target members being electrically connected to each other when one end and another end at which the conductive part is exposed are brought into contact with the different connection target members, wherein:

the conductive part is formed by solidifying a rubber elastic body including a conductive body inside the tube-like part; and at least one of the one end and the another end is a cut surface formed by cutting a major-axis columnar body having the tube-like part and the conductive part in a direction crossing the axis of the major-axis columnar body, wherein the conductive part is a magnetic conductive part to which surface treatment has been applied to increase an ease of adhesion to the rubber elastic body.

2. The elastic connector according to claim 1, wherein the conductive part is formed by forming a current flow path, in which magnetic conductive bodies are chained and oriented in the axial direction of the tube-like part, in the rubber elastic body.

3. The elastic connector according to claim 1, wherein a plurality of independent through-holes are formed inside the tube-like part, the plurality of independent through-holes being covered by the conductive part.

4. The elastic connector according to claim 1, wherein the tube-like part of the elastic connector is formed of an outer tube-like part exposed to an outside and a small-diameter tube-like part embedded inside the outer tube-like part.

5. The elastic connector according to claim 1, wherein the elastic connector has a cut trace that extends from a surface of the tube-like part to the conductive part and also extends along the axial direction of the tube-like part.

6. The elastic connector according to claim 1, wherein an end surface, on which both the conductive part and the tube-like part are exposed, is formed as an inclined surface angled with respect to the axial direction of the tube-like part.

7. An electric connection tool, used for connection target members, that has an elastic connector for electrically connecting different target members to each other by bringing one end and another end of a conductive part into contact with the different connection target members, wherein the electric connection tool has the electric connector described in claim 1 and a connector auxiliary tool that has a hole through which the elastic connector passes and is built into an electronic device while the elastic connector is held in the hole; both ends of the elastic connector extend from the hole in the connector auxiliary tool, and when the different connection target members are brought into contact with both ends, the connection target members and the elastic connector are placed in contact with each other by being pressed.

8. An elastic connector that is formed of a columnar body including an insulative tube-like part having rubber elasticity and a conductive part passing through the tube-like part in the axial direction of the tube-like part, different connection target members being electrically connected to each other when one end and another end at which the conductive part is exposed are brought into contact with the different connection target members, wherein:

the conductive part is formed by solidifying a rubber elastic body including a conductive body inside the tube-like part, and a major-axis columnar body having the tube-like part and the conductive part is cut in a direction crossing the axis of the major-axis columnar body to shorten the major-axis columnar body, wherein the conductive part is a magnetic conductive part to which surface treatment has been applied to increase an ease of adhesion to the rubber elastic body.

9. The elastic connector according to claim 8, wherein the conductive part is formed by forming a current flow path, in which magnetic conductive bodies are chained and oriented in the axial direction of the tube-like part, in the rubber elastic body.

10. The elastic connector according to claim 8, wherein a plurality of independent through-holes are formed inside the tube-like part, the plurality of independent through-holes being covered by the conductive part.

11. The elastic connector according to claim 8, wherein the tube-like part of the elastic connector is formed of an outer tube-like part exposed to an outside and a small-diameter tube-like part embedded inside the outer tube-like part.

12. The elastic connector according to claim 8, wherein the elastic connector has a cut trace that extends from a surface of the tube-like part to the conductive part and also extends along the axial direction of the tube-like part.

13. The elastic connector according to claim 8, wherein an end surface, on which both the conductive part and the tube-like part are exposed, is formed as an inclined surface angled with respect to the axial direction of the tube-like part.

14. An electric connection tool, used for connection target members, that has an elastic connector for electrically connecting different target members to each other by bringing one end and another end of a conductive part into contact with the different connection target members, wherein the electric connection tool has the electric connector described in claim 8 and a connector auxiliary tool that has a hole through which the elastic connector passes and is built into an electronic device while the elastic connector is held in the hole; both ends of the elastic connector extend from the hole in the connector auxiliary tool, and when the different connection target members are brought into contact with both ends, the connection target members and the elastic connector are placed in contact with each other by being pressed.

15. A method of manufacturing an elastic connector that is formed of a columnar body including an insulative tube-like part having rubber elasticity and a conductive part passing through the tube-like part in an axial direction of the tube-like part, different connection target members being electrically connected to each other when one end and another end at which the conductive part is exposed are brought into contact with the different connection target members, the method executes:

a conductive part filling step of filling an inside of the tube-like part with a flowable rubber elastic body in which conductive bodies are dispersed;

a step of obtaining a major-axis columnar body having the tube-like part and the conductive part by solidifying the rubber elastic body to form the conductive part inside the tube-like part; and a step of obtaining a columnar body having a cut surface on which the tube-like part and the conductive part are exposed by cutting the major-axis columnar body in a direction crossing the axis of the major-axis columnar body to shorten the major-axis columnar body.

16. The method of manufacturing an elastic connector according to claim 15, wherein the process of obtaining the major-axis columnar body is a process of applying a magnetic field to a rubber elastic body including magnetic conductive bodies along an axial direction thereof to orient the magnetic conductive bodies and then hardening the rubber elastic body.

* * * * *